US010155570B2

(12) United States Patent
Aimcharoenchaiyakul

(10) Patent No.: US 10,155,570 B2
(45) **Date of Patent: *Dec. 18, 2018**

(54) SYSTEMS, DEVICES, CONTROLLERS, AND METHODS FOR USE IN A FLOATING PRODUCTION STORAGE AND OFFLOADING VESSEL

(71) Applicant: PTT EXPLORATION AND PRODUCTION PUBLIC COMPANY LIMITED, Bangkok (TH)

(72) Inventor: Manit Aimcharoenchaiyakul, Bangkok (TH)

(73) Assignee: PTT Exploration and Production Public Company Limited, Bangkok (TH)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,744

(22) Filed: Oct. 19, 2017

(65) Prior Publication Data

US 2018/0037301 A1 Feb. 8, 2018

Related U.S. Application Data

(63) Continuation of application No. 15/329,226, filed as application No. PCT/TH2015/000084 on Nov. 27, 2015, now Pat. No. 9,828,070.

(51) Int. Cl.
*B63B 21/50* (2006.01)
*B63B 21/22* (2006.01)
(Continued)

(52) U.S. Cl.
CPC ..... *B63B 21/507* (2013.01); *B63B 21/10* (2013.01); *B63B 21/227* (2013.01); *B63B 2003/147* (2013.01); *B63B 2035/448* (2013.01)

(58) Field of Classification Search
CPC ..... B63B 21/507; B63B 21/10
See application file for complete search history.

(56) References Cited

U.S. PATENT DOCUMENTS 3,774,562 A 11/1973 Dean, III
4,446,807 A * 5/1984 Johnson ..... B63B 21/50 114/230.23

(Continued)

FOREIGN PATENT DOCUMENTS

CN 1226863 A 8/1999
CN 1275109 A 11/2000

(Continued)

OTHER PUBLICATIONS

International Search Report and Written Opinion of the International Searching Authority of international application No. PCT/TH2015/000084, dated Jul. 25, 2016.

*Primary Examiner* — Stephen P Avila
(74) *Attorney, Agent, or Firm* — Baker & McKenzie LLP

(57) ABSTRACT

Embodiments relate generally to a turret system for use in a floating vessel. The turret system may comprise a turret body and windlass subsystem. The turret system may comprise top and bottom surfaces, first and second mooring line storage sections, and first and second mooring line channel sections. Each mooring line storage section may include an opening and cavity. Each opening is operable to receive a mooring line. The first and second mooring line channel sections may be separate elongated passageways for first and second mooring lines, respectively, to be directed through the turret body and an exterior of the floating vessel without coming into contact with one another. The windlass subsystem may comprise a rotatable member, and configured to be transportable between locations. When the windlass assembly is configured to be secured to the turret body, the (Continued)

windlass assembly is configurable to control a movement of a mooring line.

21 Claims, 17 Drawing Sheets

(51) Int. Cl.

| | |
|---|---|
| ***B63B 21/10*** | (2006.01) |
| *B63B 3/14* | (2006.01) |
| *B63B 35/44* | (2006.01) |

(56) References Cited

U.S. PATENT DOCUMENTS

| | | | |
|---|---|---|---|
| 4,566,398 | A | 1/1986 | Sasaki et al. |
| 5,860,840 | A | 1/1999 | Boatman et al. |
| 6,302,048 | B1 | 10/2001 | Smedal |
| 6,314,901 | B1 | 11/2001 | Smedal |
| 6,494,271 | B2 | 12/2002 | Wilson |
| 7,458,425 | B2 | 12/2008 | Millheim |
| 7,775,175 | B2 | 8/2010 | Akestad |
| 9,828,070 | B2 * | 11/2017 | Aimcharoenchaiyakul ..... B63B 21/507 |
| 2017/0267317 | A1 | 9/2017 | Aimcharoenchaiyakul |

FOREIGN PATENT DOCUMENTS

| | | | |
|---|---|---|---|
| GB | 1585856 | A | 3/1981 |
| WO | 2017091160 | A1 | 6/2017 |

* cited by examiner

SYSTEMS, DEVICES, CONTROLLERS, AND METHODS FOR USE IN A FLOATING PRODUCTION STORAGE AND OFFLOADING VESSEL

CROSS-REFERENCE TO RELATED APPLICATIONS

This application is a continuation of and claims priority to U.S. patent application Ser. No. 15/329,226 filed on Jan. 25, 2017; this application claims priority to International Patent Application No. PCT/TH2015/000084 filed Nov. 27, 2015, of which U.S. patent application Ser. No. 15/329,226 is a National Stage Application. The contents of the aforementioned priority applications are hereby incorporated by reference in their entirety.

BACKGROUND

The present disclosure relates generally to systems, devices, controllers, and methods for use in a floating production storage and offloading (FPSO) vessel, and more specifically, to turret systems and windlass assemblies for use in FPSO vessels.

In general, a vessel, such as a floating production storage and offloading (FPSO) vessel, may be used to extract valuable hydrocarbons from a natural reservoir source located at a particular area under a bottom of a body of water (such as an ocean, sea, etc.). The extraction process may take several years for large reservoirs, and typically less time may be required for smaller (marginal) reservoirs.

In order to perform the extracting of such hydrocarbons, the FPSO vessel is required to be securably positioned relative to a location on the bottom of the body of water. Due to the large size of FPSO vessels, this is generally achieved by using a plurality of mooring lines having anchors at its distal end. In preparation for doing so, a tremendous amount of planning, including, but not limited to, measuring the depth range of each location to be anchored, calculating tension requirements of each of the mooring lines, calculating length requirements of each of the mooring lines, calculating number of mooring lines required, etc. Once preparations are complete, a distal end of each mooring line is pulled from the FPSO vessel using small vessels and dropped to anchor to a location on the bottom of the body of water. Each mooring line is then tensioned based on the pre-calculations, and fixedly secured to a turret system of the FPSO vessel.

BRIEF SUMMARY

It is recognized in the present disclosure that conventional approaches to securing an FPSO vessel relative to a location of a bottom of a body of water is difficult, time-consuming, and requires a tremendous amount of preparation and planning. Furthermore, such planning and pre-calculations may not reflect the current or future conditions for the FPSO vessel, such as depth, tension requirements, length requirements of each mooring line, etc.

Present example embodiments relate generally to systems, devices, controllers, and methods for use in a vessel, such as a floating production storage and offloading (FPSO) vessel.

In an exemplary embodiment, a turret system is described. The turret system may be for use in a floating vessel. The floating vessel may include a hull and a moon pool opening. The turret system may include a turret body and a transportable windlass subsystem. The turret body may be fixedly positionable in the moon pool opening and rotatable about a center axis defined by the moon pool opening. The turret body may include a top surface, a bottom surface opposite to the top surface, a first mooring line storage section, a first mooring line channel section, a second mooring line storage section, and a second mooring line channel section. The first mooring line storage section may include a first opening in the turret body top surface and a first cavity formed between the turret body top surface and turret body bottom surface. The first opening may be operable to receive a first mooring line. The first cavity may be operable to house at least a majority length of the first mooring line. The first mooring line channel section may be formed through the turret body between the turret body top surface and turret body bottom surface. The first mooring line channel section may be an elongated passageway for the first mooring line to pass between an exterior of the floating vessel and the first mooring line storage section. The second mooring line storage section may include a second opening in the turret body top surface and a second cavity formed between the turret body top surface and turret body bottom surface. The second opening may be operable to receive a second mooring line. The second cavity may be operable to house at least a majority length of the second mooring line. The second mooring line channel section may be formed through the turret body between the turret body top surface and turret body bottom surface. The second mooring line channel section may be an elongated passageway for the second mooring line to pass between an exterior of the floating vessel and the second mooring line storage section. The first and second mooring line channel sections may be separate elongated passageways so as to enable the first mooring line and second mooring line, respectively, to be directed through the turret body to the exterior of the floating vessel without coming into contact with one another. The transportable windlass subsystem may include a rotatable member configurable to rotate in a first direction and a second direction opposite to the first direction. The transportable windlass system may be configurable to be securable to and transportable between a plurality of locations of the turret body.

In another exemplary embodiment, a windlass assembly is disclosed. The windlass assembly may be for use in a turret system of a floating vessel. The turret system may include a turret body positioned in a moon pool opening and rotatable about a center axis defined by the moon pool opening. The turret body may include a mooring line storage section and a mooring line channel section. The mooring line storage section may include a first opening and a first cavity. The first opening may be operable to receive a mooring line. The mooring line channel section may be an elongated passageway for the mooring line to pass between an exterior of the floating vessel and the mooring line storage section. The windlass assembly may include a hoisting assembly. The hoisting assembly may be configurable in such a way that, when the hoisting assembly is positioned above a first location between the mooring line storage section and the mooring line channel section, the hoisting assembly is operable to control at least a position of a portion of the mooring line that is between the mooring line storage section and the mooring line channel section.

In yet another exemplary embodiment, a turret system is described. The turret system may be for use in a floating vessel. The floating vessel may include a hull and a moon pool opening. The turret system may include a turret body fixedly positionable in the moon pool opening and rotatable about a center axis defined by the moon pool opening. The turret body may include a top surface, a bottom surface opposite to the top surface, a first mooring line storage section, a first mooring line channel section, a second mooring line storage section, a second mooring line channel section, a first front mooring line stopper assembly, and a first rear mooring line stopper assembly. The first mooring line storage section may include a first opening in the turret body top surface and a first cavity formed between the turret body top surface and turret body bottom surface. The first opening may be operable to receive a first mooring line. The first cavity may be operable to house at least a majority length of the first mooring line. The first mooring line channel section may be formed through the turret body between the turret body top surface and turret body bottom surface. The first mooring line channel section may be an elongated passageway for the first mooring line to pass between an exterior of the floating vessel and the first mooring line storage section. The second mooring line storage section may include a second opening in the turret body top surface and a second cavity formed between the turret body top surface and turret body bottom surface. The second opening may be operable to receive a second mooring line. The second cavity may be operable to house at least a majority length of the second mooring line. The second mooring line channel section may be formed through the turret body between the turret body top surface and turret body bottom surface. The second mooring line channel section may be an elongated passageway for the second mooring line to pass between an exterior of the floating vessel and the second mooring line storage section. The first and second mooring line channel sections may be separate elongated passageways so as to enable the first mooring line and second mooring line, respectively, to be directed through the turret body to the exterior of the floating vessel without coming into contact with one another. The first front mooring line stopper assembly may be operable to receive the first mooring line. The first front mooring line stopper assembly may be actuatable between a stop position and a release position. The first front mooring line stopper assembly may be provided between the first mooring line channel section and the first opening of the first mooring line storage section. The first rear mooring line stopper assembly may be operable to receive the first mooring line. The first rear mooring line stopper assembly may be separate from the first front mooring line stopper assembly. The first rear mooring line stopper assembly may be actuatable between a stop position and a release position. The first rear mooring line stopper assembly may be provided between the first front mooring line stopper assembly and the first opening of the first mooring line storage section. When the first front mooring line stopper assembly receives the first mooring line and when the first front mooring line stopper assembly is actuated to its stop position, the first front mooring line stopper assembly may be operable to restrict a movement of the first mooring line through the first mooring line channel section. When the first front mooring line stopper assembly is actuated to the its release position, the first front mooring line stopper assembly may be operable to allow a movement of the first mooring line through the first mooring line channel section. When the first rear mooring line stopper assembly receives the first mooring line and when the first rear mooring line stopper assembly is actuated to its stop position, the first rear mooring line stopper assembly may be operable to restrict a movement of the first mooring line through the first opening of the first mooring line storage section. When the first rear mooring line stopper assembly is actuated to the its release position, the first rear mooring line stopper assembly may be operable to allow a movement of the first mooring line through the first opening of the first mooring line storage section.

BRIEF DESCRIPTION OF THE DRAWINGS

For a more complete understanding of the present disclosure, example embodiments, and their advantages, reference is now made to the following description taken in conjunction with the accompanying drawings, in which like reference numbers indicate like features, and.

Although similar reference numbers may be used to refer to similar elements in the figures for convenience, it can be appreciated that each of the various example embodiments may be considered to be distinct variations.

Figure 1:
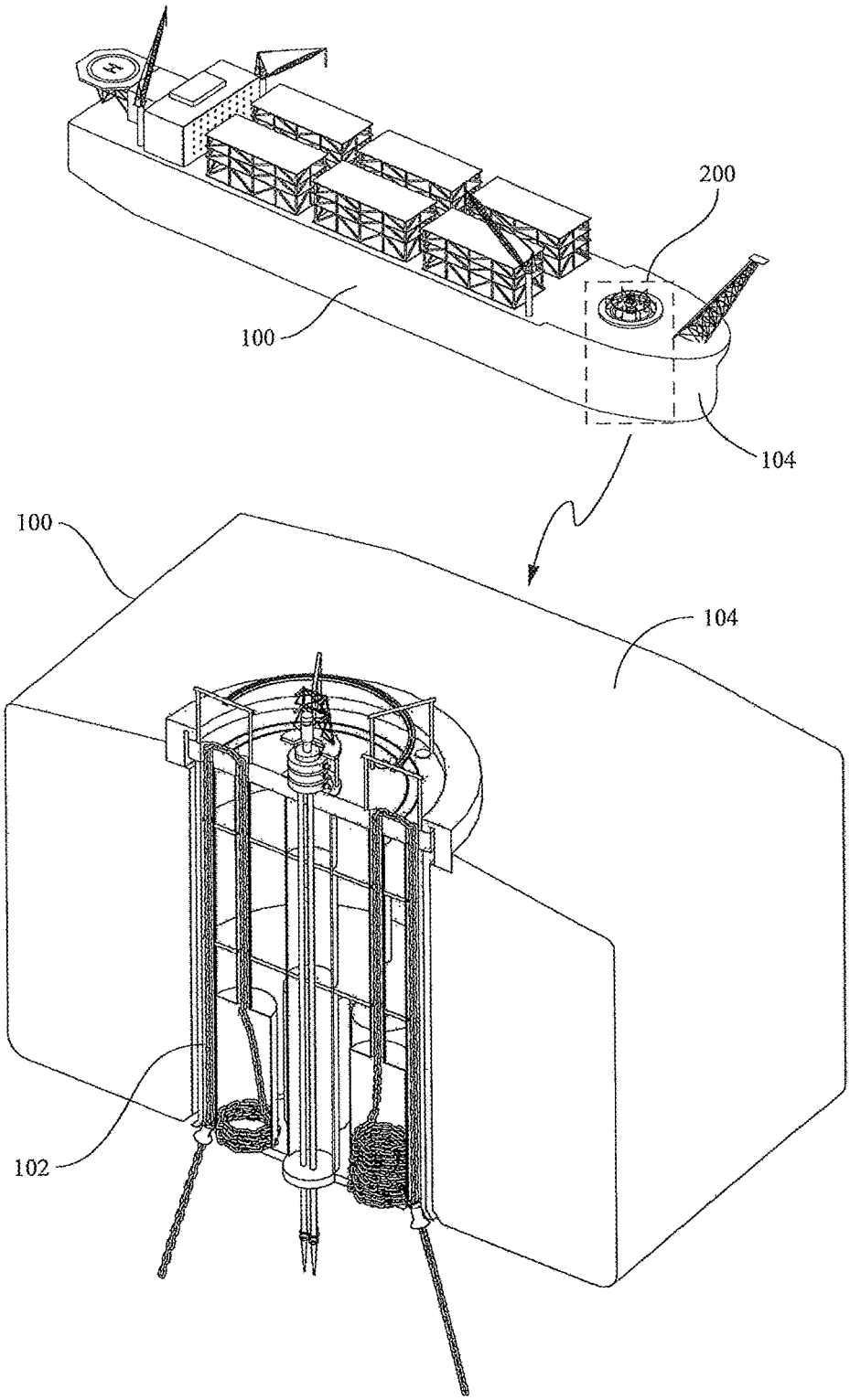
FIG. 1 is perspective view of an example embodiment of a floating vessel.

Example embodiments will now be described with reference to the accompanying drawings, which form a part of the present disclosure and which illustrate example embodiments which may be practiced. As used in the present disclosure and the appended claims, the terms "example embodiment", "exemplary embodiment", and "present embodiment" do not necessarily refer to a single embodiment, although they may, and various example embodiments may be readily combined and/or interchanged without departing from the scope or spirit of example embodiments. Furthermore, the terminology as used in the present disclosure and the appended claims is for the purpose of describing example embodiments only and is not intended to be limitations. In this respect, as used in the present disclosure and the appended claims, the term "in" may include "in" and "on", and the terms "a", "an", and "the" may include singular and plural references. Furthermore, as used in the present disclosure and the appended claims, the term "by" may also mean "from", depending on the context. Furthermore, as used in the present disclosure and the appended claims, the term "if" may also mean "when" or "upon", depending on the context. Furthermore, as used in the present disclosure and the appended claims, the words "and/or" may refer to and encompass any and all possible combinations of one or more of the associated listed items.

DETAILED DESCRIPTION

It is recognized in the present disclosure that conventional approaches, systems, devices, and methods for use in securing a floating vessel, such as a floating storage and offloading vessel and/or floating production storage and offloading vessel, relative to a location of a bottom of a body of water are difficult and time-consuming to perform, and also requires a tremendous amount of preparation, planning, measurements, and calculations. Furthermore, such planning and pre-calculations may not reflect the current and/or future conditions and/or requirements for the vessel, including requirements pertaining to depth, tension, and length of each of the plurality of mooring line, etc.

Present example embodiments relate generally to systems, subsystems, devices, controllers, and methods for use in, among other things, controlling and/or securing a position of a vessel relative to a bottom of a body of water.

Example embodiments relate to and/or comprise a turret system, or the like. The turret system may include a turret body and a windlass subsystem. The turret body may include one or more mooring line storage sections and one or more mooring line channel sections for use in receiving, housing, guiding, allowing passage, and/or storing one or more mooring lines. In example embodiments, each mooring line channel section may have a correspondence with a mooring line storage section, and such correspondence may include the handling of a common or the same mooring line. In respect to the windlass subsystem, the windlass subsystem may comprise a transportable and/or portable windlass subsystem (hereinafter "transportable windlass subsystem") having a rotary member, or the like. The transportable windlass subsystem may also comprise a plurality of transport mechanisms, such as wheels or the like, for use in transporting (or moving) the transportable windlass subsystem between a plurality of locations. The transportable windlass subsystem may further comprise a break mechanism, or the like, for securing a position of the transportable windlass subsystem relative to a location on the turret body. The windlass subsystem may also comprise a windlass rail assembly for use in enabling the transportable windlass subsystem to be positioned and/or secured at a location, and/or transported between a plurality of locations.

The turret system may also include a plurality of fairlead assemblies. Each fairlead assembly may be for use in guiding a mooring chain between a mooring line channel section and a mooring line storage section. Each of the plurality of fairlead assemblies may also be operable to guide a mooring chain between a mooring line channel section and a transportable windlass subsystem when the transportable windlass subsystem is positioned at a position between the mooring line channel section and its corresponding mooring line storage section.

The turret system may further include a plurality of mooring line stopper assemblies for use in restricting a movement of a mooring line and/or allowing a movement of a mooring line.

The turret system may further comprise a hoisting assembly for use in controlling a position of a mooring chain. The hoisting assembly may be for use in lifting a mooring chain and/or lowering a mooring chain. The hoisting assembly may also be for use in placing or configuring a mooring chain onto a transportable windlass subsystem and removing or unconfiguring a mooring chain from a transportable windlass subsystem. In other words, the hoisting assembly may be operable to set up a transportable windlass subsystem to enable the transportable windlass subsystem to control a movement of a mooring line. Also, the hoisting assembly may be operable to remove a mooring line from the transportable windlass subsystem when the transportable windlass subsystem is no longer needed to control a movement of a mooring line. The hoisting assembly may also comprise a plurality of transport mechanisms, such as wheels or the like, for use in transporting (or moving) the hoisting assembly between a plurality of locations. The hoisting assembly may further comprise a break mechanism, or the like, for securing a position of the hoisting assembly relative to a location on the turret body.

The turret system may further comprise a hoisting rail assembly for use in enabling the hoisting assembly to be positioned and/or secured at a location, and/or transported between a plurality of locations.

The turret system may also have a controller, or the like, for use in controlling one or more elements of the turret system. Such control may include controlling movement, position, and actuating, gathering information, performing measurements, and the like.

These and other example embodiments will now be described with reference to the accompanying drawings.

The Vessel (e.g., Vessel 100)

Figure 2:
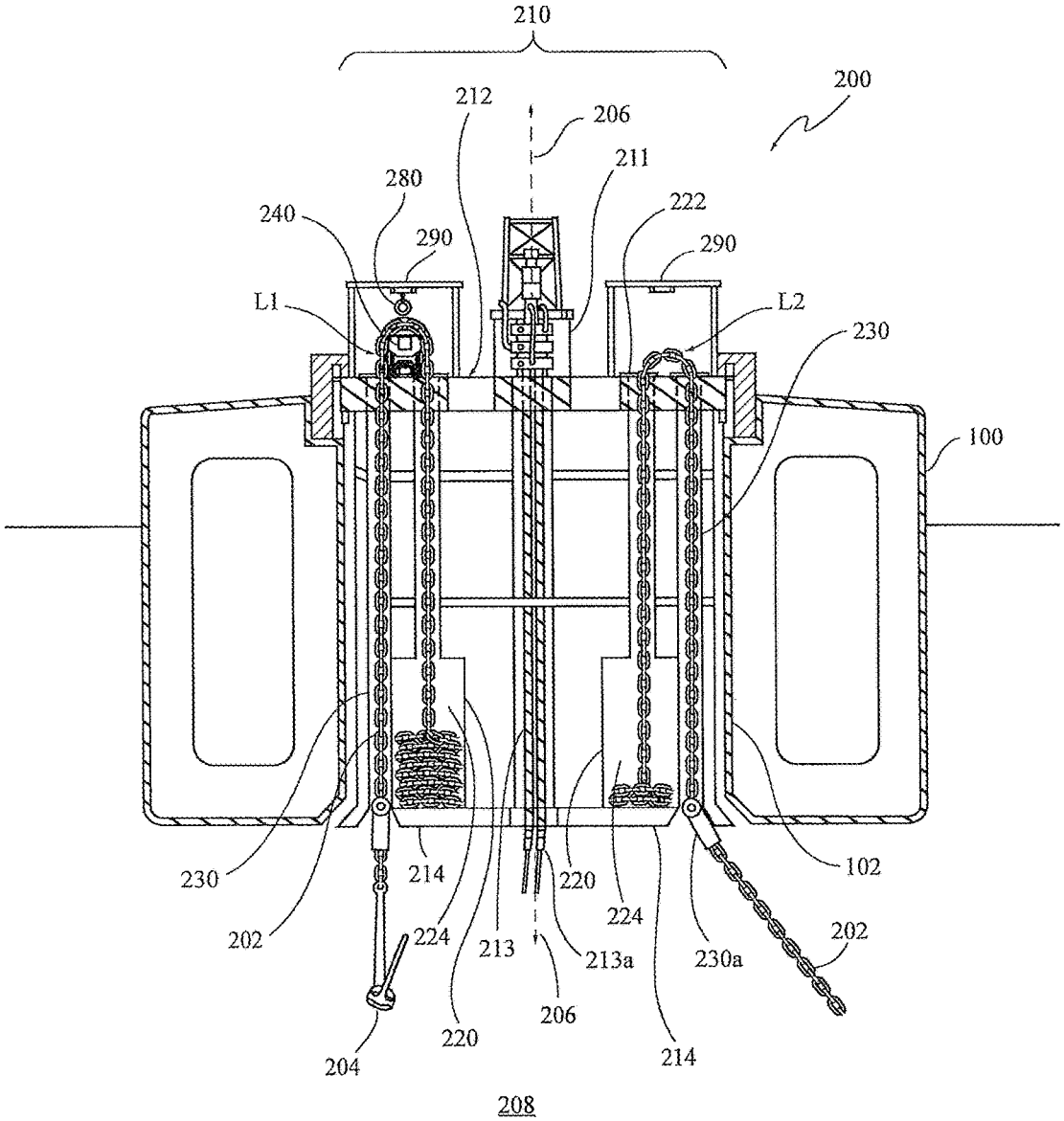
FIG. 2 is a cross-sectional view of an example embodiment of a turret system.
Figure 3:
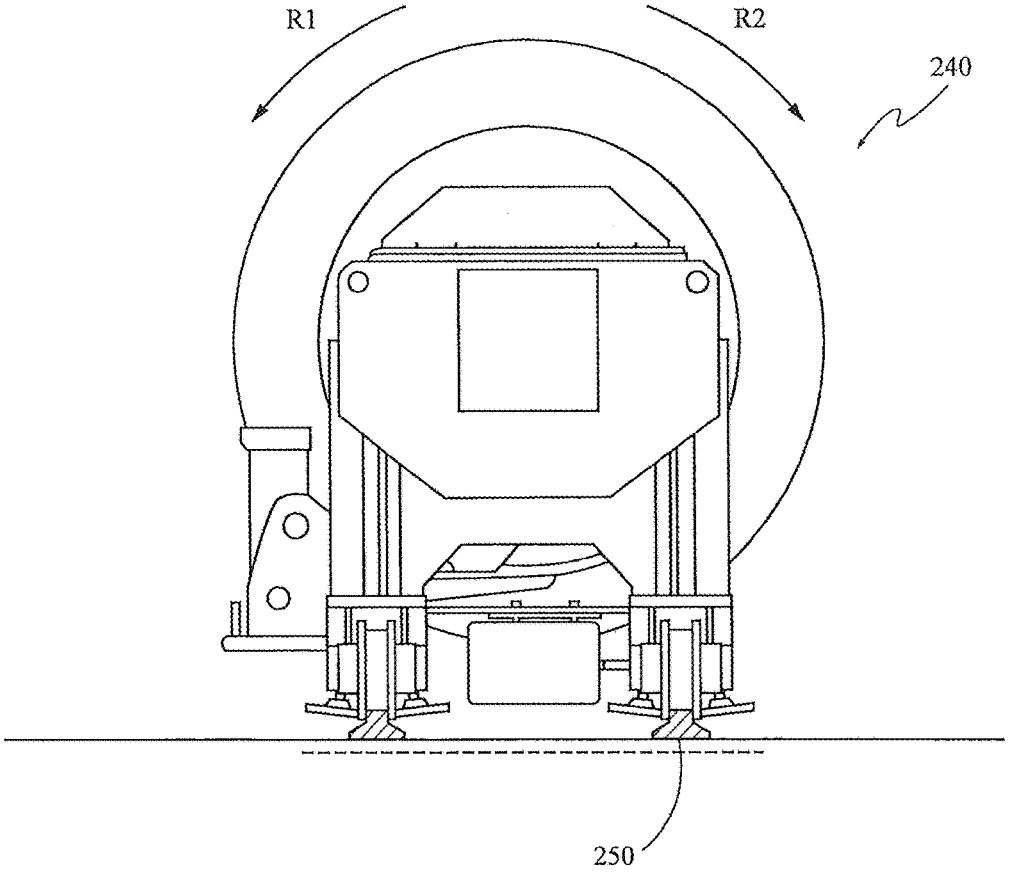
FIG. 3 is a front view of an example embodiment of a transportable windlass assembly.

FIG. 1 illustrates an example embodiment of a vessel 100. The vessel 100 may be any vessel, including a full sized or marginal floating production storage and offloading (FPSO) vessel, or the like. The FPSO vessel 100 may include a hull and a moon pool opening 102 in a bow section 104 of the hull. The moon pool opening 102 may be formed in one or more of a plurality of shapes and sizes. For example, the moon pool opening 102 may include a substantially circular cross-section and an overall substantially cylindrical shape, as illustrated in FIGS. 1 and 2.

The Turret System (e.g., Turret System 200)

The vessel 100 may comprise a turret system, or the like. The turret system may be for use in an FPSO vessel 100. As illustrated in at least FIG. 2, an example embodiment of the turret system (e.g., turret system 200) may comprise, among other things, a turret body (e.g., turret body 210) and a windlass subsystem (e.g., transportable windlass subsystem 240). The turret system 200 may further comprise one or more mooring line storage sections (e.g., mooring line storage section 220) and one or more mooring line channel sections (e.g., mooring line channel section 230). The turret system 200 may further comprise one or more windlass subsystems (e.g., transportable windlass subsystem 240). The turret system 200 may further comprise one or more windlass rail assemblies (e.g., windlass rail assembly 250). The turret system 200 may further comprise one or more fairlead assemblies (e.g., fairlead assemblies 260). The turret system 200 may further comprise one or more mooring line stoppers (e.g., mooring line stoppers 270). The turret system 200 may further comprise one or more hoisting assemblies (e.g., hoisting assembly 280). The turret system 200 may further comprise one or more hoisting rail assemblies (e.g., hoisting rail assembly 290). These and other elements of an example embodiment of the turret system 200 will now be described below with reference to FIGS. 1 to 13. The turret system 200 may further comprise a bearing assembly (not shown), or the like, to enable free rotation relative to the vessel 100. The turret system 200 may further comprise a swivel portion 211, or the like, located on the top surface 212 (or main deck), including, among other things, manifolds, piping systems, and/or controls for use in transferring hydrocarbons. The turret system 200 may further comprise a riser line channel 213, or the like, (and may also include a riser bend stiffener) operable to receive and guide a riser 213*a* from a bottom of the turret to above the top surface 212. Furthermore, the turret system 200 may comprise a mooring line adjustable hawse assembly 230*a* secured to a distal or bottom end of the mooring line channel section 230.

(1) The Turret Body (e.g., Turret Body 210)

An example embodiment of the turret body (e.g., turret body 210) may be fixedly positionable in the moon pool opening 102 of the vessel 100 and rotatable about a center axis 206 defined by the moon pool opening 102. The bearing assembly (not shown) of the turret system 200 may be operable to enable such rotation of the turret body 210 relative to the vessel 100, and enable a transfer of dynamic load from the structure of the turret body 210, as well as the risers and mooring lines (and systems and subsystems thereof), to the vessel 100. The turret body 210 may comprise, among other things, a top surface 212 (or "main deck 212"), a bottom surface 214 opposite to the top surface 212, a mooring line storage section (e.g., mooring line storage section 220), and a mooring line channel section (e.g., mooring line channel section 230) in example embodiments. The turret body top surface 212 may be for use in, among other things, allowing a workable surface for operators of the turret system 200. The turret body top surface 212 may also be for use in, among other things, securing a position and/or allowing transport of one or more windlass subsystems (e.g., transportable windlass subsystem 240). The turret body top surface 212 may also be for use to secure one or more windlass rail assemblies (e.g., windlass rail assembly 250 as illustrated in at least FIG. 6). The turret body top surface 212 may also be operable to secure the swivel portion 211 to associated support systems. The turret body 210 may also be for use to secure one or more fairlead assemblies (e.g., fairlead assembly 260 as illustrated in at least FIG. 6). The turret body 210 may also be for use to secure one or more mooring line stoppers (e.g., mooring line stoppers 270 as illustrated in at least FIG. 6). The turret body 210 may also be for use to secure and/or allow transport of one or more hoisting assemblies (e.g., hoisting assembly 280). The turret body 210 may also be for use to secure one or more hoisting rail assemblies (e.g., hoisting rail assembly 290).

The turret body 210 may be formed in one or more of a plurality of shapes and sizes. For example, the shape and size of the turret body 210 may correspond with the shape and size of the moon pool opening 102 of the vessel 100. In this regard, the turret body 210 may include a substantially circular cross-section and an overall substantially cylindrical shape.

(2) Mooring Line Storage Section (e.g., Mooring Line Storage Section 220)

As illustrated in at least FIG. 2, an example embodiment of the turret body 210 may comprise one or more mooring line storage sections (e.g., mooring line storage section 220). In an example embodiment, the turret body 210 may comprise a first mooring line storage section 220 (e.g., the mooring line storage section 220 illustrated on the left hand side of FIG. 2). The first mooring line storage section 220 may include a first opening 222 (e.g., the first opening 222 illustrated on the left hand side of FIG. 2) in the turret body top surface 212 and a first cavity 224 (e.g., the first cavity 224 illustrated on the left hand side of FIG. 2) formed between the turret body top surface 212 and turret body bottom surface 214. The first opening 222 may operable to receive a first mooring line 202 (e.g., the mooring line 202 illustrated on the left hand side of FIG. 2). The first cavity 224 may be operable to house at least a majority length of the first mooring line 202.

The turret body 210 may also include a second mooring line storage section 220 (e.g., the mooring line storage section 220 illustrated on the right hand side of FIG. 2). The second mooring line storage section 220 may include a second opening 222 (e.g., the second opening 222 illustrated on the right hand side of FIG. 2) in the turret body top surface 212 and a second cavity 224 (e.g., the second cavity 224 illustrated on the right hand side of FIG. 2) formed between the turret body top surface 212 and turret body bottom surface 214. The second opening 222 may be operable to receive a second mooring line 202 (e.g., the mooring line 202 illustrated on the left hand side of FIG. 2). The second cavity may be operable to house at least a majority length of the second mooring line.

Figure 4A:
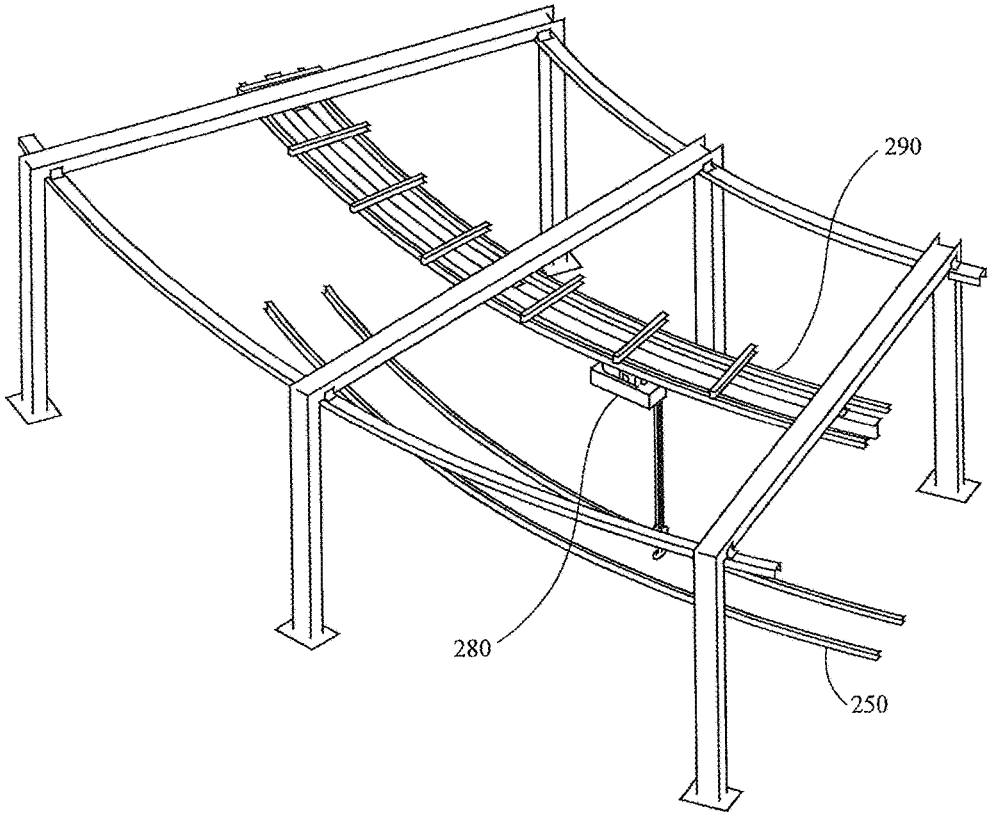
FIG. 4A is a perspective view of an example embodiment of a windlass rail assembly, a hoisting rail assembly, and a hoisting assembly.
Figure 4B:
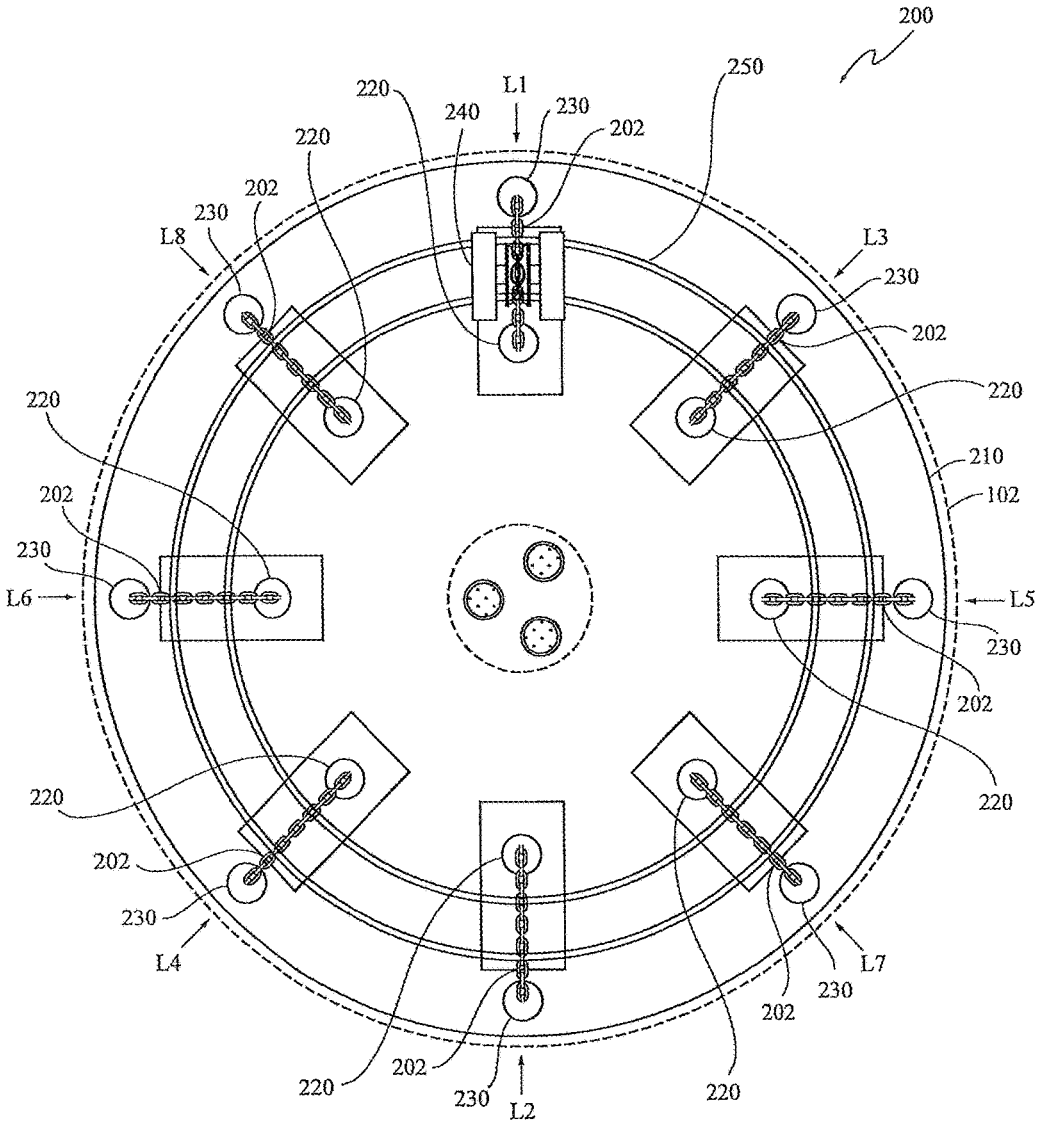
FIG. 4B is a top view of an example embodiment of a turret system.
Figure 4C:
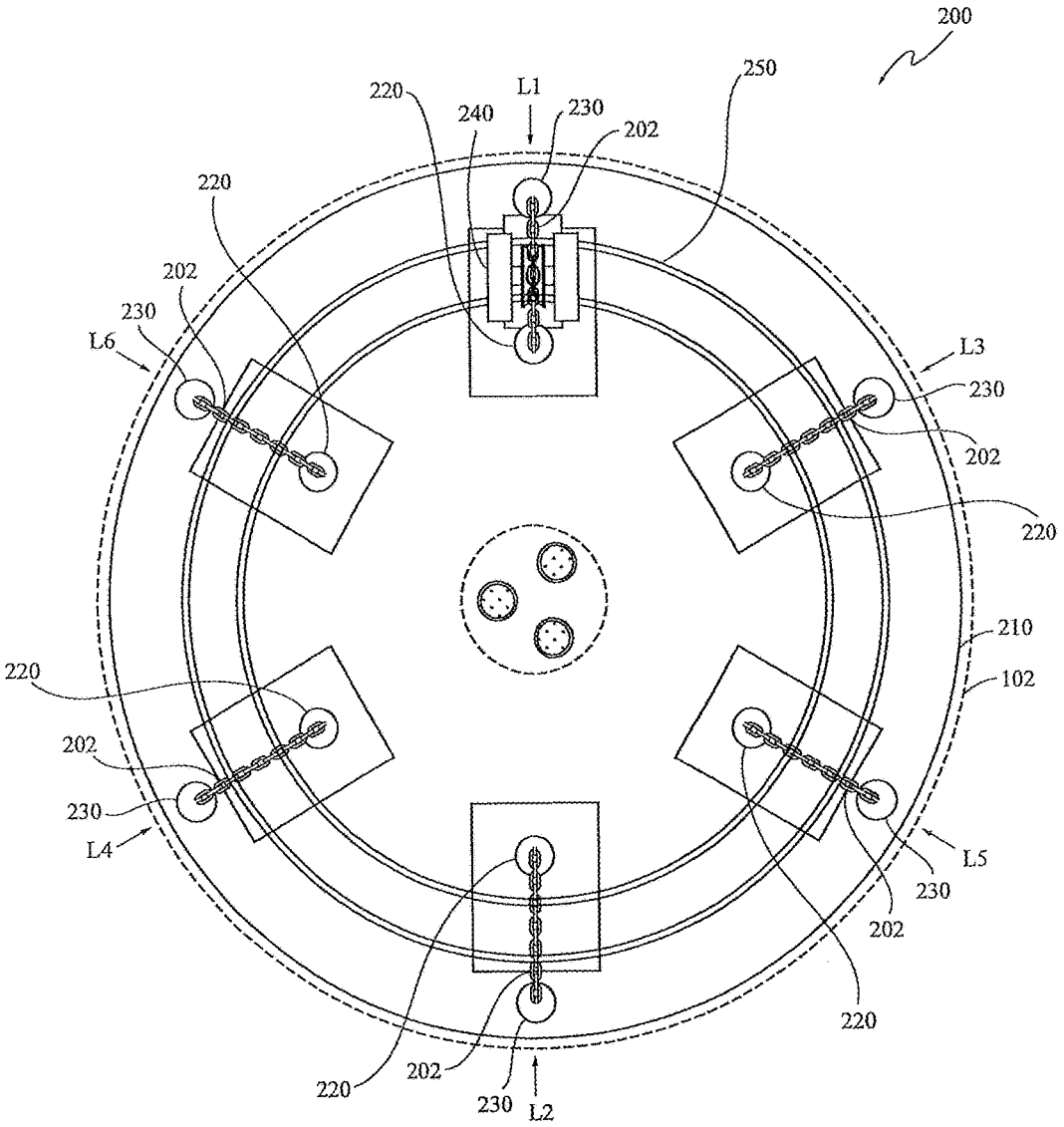
FIG. 4C is a top view of another example embodiment of a turret system.
Figure 4D:
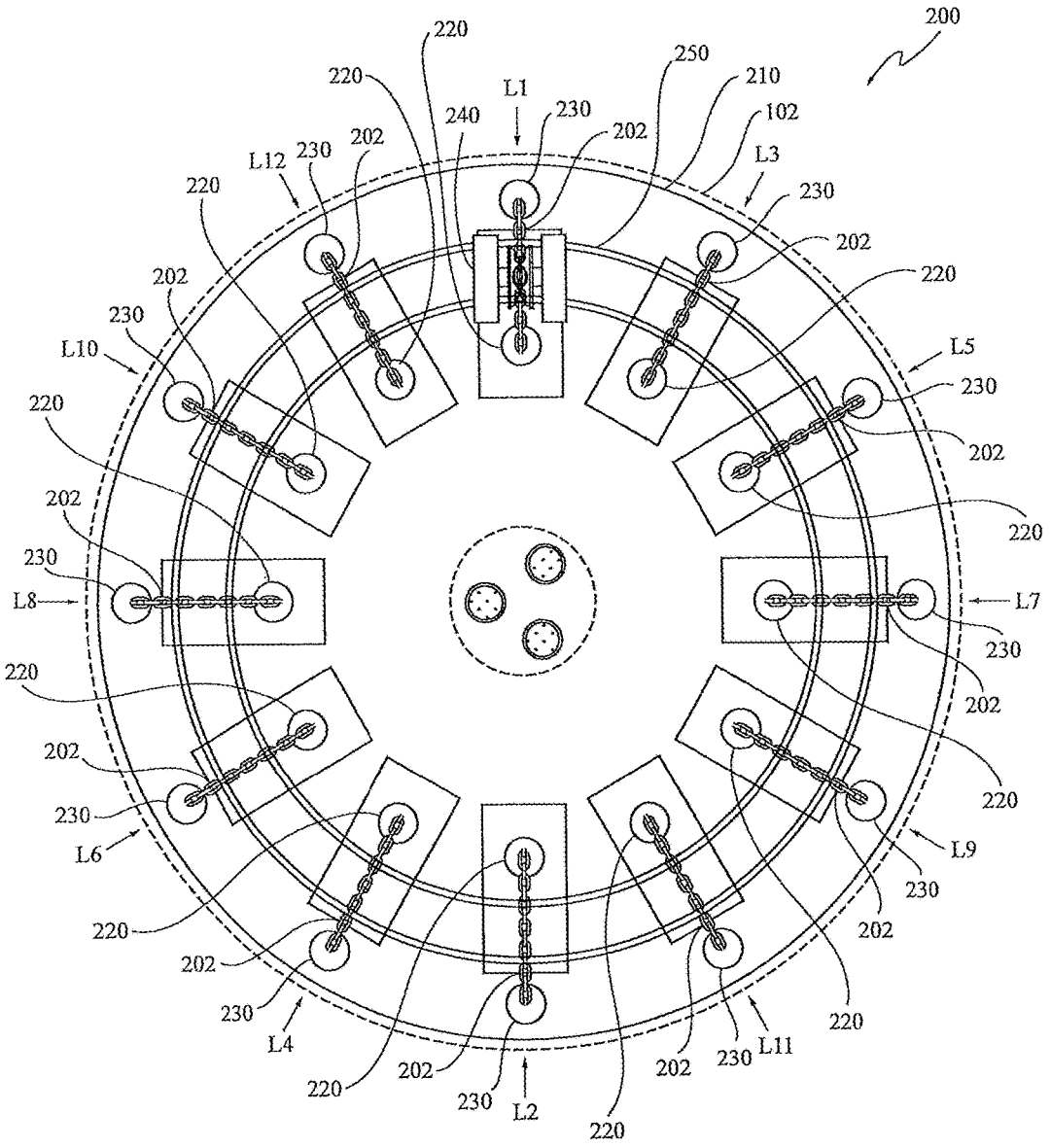
FIG. 4D is a top view of another example embodiment of a turret system.

The turret body 210 may include any number of mooring line storage sections 220. In an example embodiment, as illustrated in FIG. 4B, the turret body 210 may comprise eight mooring line storage sections 220. In another example embodiment, as illustrated in FIG. 4C and FIG. 4D, the turret body 210 may also comprise six or twelve mooring line storage sections 220, respectively. Other quantities of the mooring line storage section 220 other than those illustrated in FIG. 4B, FIG. 4C, and FIG. 4D are also contemplated without departing from the teachings of the present disclosure.

In example embodiments, the turret body 210 may comprise one or more common mooring line storage sections 220 separated by areas, partitions, walls, or the like, instead of a plurality of separate mooring line storage sections 220.

It is to be understood in the present disclosure that the cavity 224 of the mooring line storage section 220 may comprise a termination point (not shown), or the like, secured to a wall of the cavity 224, which may be for use in securing a proximate end of a mooring line 202 to the vessel 100 (i.e., the distal end of the mooring line 202 is secured to an anchor 204).

The mooring line storage section 220, including the opening 222 and the cavity 224, may be formed in one or more of a plurality of shapes and sizes. In an example embodiment, the shape and size of the mooring line storage section 220 may be determined based on expected maximum shapes and sizes of the mooring lines 202 to be used for the vessel 100. In addition to or in replacement, the shape and size of the mooring line storage section 220 may be determined based on, among other things, the number of mooring lines 202 to be used, the number of mooring line storage sections 220, the number of mooring line channel sections 230, the maximum depth of the body of water, etc.

(3) Mooring Line Channel Section (e.g., Mooring Line Channel Section 230)

As illustrated in at least FIG. 2, an example embodiment of the turret body 210 may comprise one or more mooring line channel sections (e.g., the mooring line channel section 230). In an example embodiment, the turret body 210 may comprise a first mooring line channel section 230 (e.g., the mooring line channel section 230 illustrated on the left hand side of FIG. 2). The first mooring line channel section 230 may be formed through the turret body 210 between the turret body top surface 212 and turret body bottom surface 214. The first mooring line channel section 230 may be an elongated passageway for a first mooring line 202 (e.g., the mooring line 202 illustrated on the left hand side of FIG. 2) to pass between an exterior 208 of the vessel 100 and a first mooring line storage section 220 (e.g., the mooring line storage section 220 illustrated on the left hand side of FIG. 2).

The turret body 210 may also include a second mooring line channel section 230 (e.g., the mooring line channel section 230 illustrated on the right hand side of FIG. 2). The second mooring line channel section 230 may be formed through the turret body 210 between the turret body top surface 212 and turret body bottom surface 214. The second mooring line channel section 230 may be an elongated passageway for a second mooring line 202 (e.g., the mooring line 202 illustrated on the right hand side of FIG. 2) to pass between an exterior 208 of the vessel 100 and a second mooring line storage section 220 (e.g., the mooring line storage section 220 illustrated on the right hand side of FIG. 2).

The turret body 210 may include any number of mooring line channel sections 230. In an example embodiment, as illustrated in FIG. 4B, the turret body 210 may comprise eight mooring line channel sections 230. In another example embodiment, as illustrated in FIG. 4C and FIG. 4D, the turret body 210 may comprise six or twelve mooring line channel sections 230, respectively. Other quantities of the mooring line channel section 230 other than those illustrated in FIG. 4B, FIG. 4C, and FIG. 4D are also contemplated without departing from the teachings of the present disclosure.

In an example embodiment, the turret body 210 may comprise one or more common mooring line channel sections 230 separated by areas, partitions, walls, or the like, instead of a plurality of separate mooring channel storage sections 230.

The mooring line channel section 230 may be formed in one or more of a plurality of shapes and sizes. In an example embodiment, the shape and size of the mooring line channel section 230 may be determined based on expected maximum shapes and sizes of the mooring lines 202 to be used for the vessel 100. In addition to or in replacement, the shape and size of the mooring line channel section 230 may be determined based on, among other things, the number of mooring lines 202 to be used, the number of mooring line storage sections 220, the number of mooring line channel sections 230, the maximum depth of the body of water, etc.

(4) Windlass Subsystem (e.g., Windlass Subsystem 240)

The turret system 200 may also comprise a windlass subsystem (e.g., transportable windlass subsystem 240), as illustrated in at least FIGS. 2, 3, 4B, 4C, 5, 6, 7, and 9-11. As illustrated in at least FIG. 3 and FIG. 5, an example embodiment of the transportable windlass subsystem 240 may include a rotatable member 244*a*, such as a spool (e.g., a gypsy spool or wildcat spool), or the like. The rotatable member 244*a* may be configurable to rotate in a first direction R1 and a second direction R2 opposite to the first direction R1.

As illustrated in at least FIGS. 2 and 4B, the transportable windlass subsystem 240 may be configured to be securable to one or more of a plurality of locations on the turret body top surface 212, including a first location L1 and a second location L2. It is to be understood in the present disclosure that the transportable windlass subsystem 240 may also be securable to other locations, such as one or more of locations L3-L8 illustrated in FIG. 4B, without departing from the teachings of the present disclosure. Furthermore, as illustrated in at least FIGS. 2 and 4B, the transportable windlass subsystem 240 may be configured to be transportable between a plurality of locations on the turret body top surface 212, including the first location L1 and the second location L2. It is to be understood in the present disclosure that the transportable windlass subsystem 240 may also be transportable between other locations, such as one or more of locations L3-L8 illustrated in FIG. 4B, without departing from the teachings of the present disclosure.

As illustrated in at least FIG. 4B, the first location L1 may be a location on the turret body top surface 212 between a first mooring line channel section 230 and a first opening 222 of a first mooring line storage section 220. For example, the first location L1 may be a location on the turret body top surface 212 between the first mooring line channel section 230 illustrated on the left hand side of FIG. 2 (or top of FIG. 4B) and the first opening 222 of the first mooring line storage section 220 illustrated on the left hand side of FIG. 2 (or top of FIG. 4B).

Similarly, as illustrated in at least FIG. 4B, the second location L2 may be a location on the turret body top surface 212 between a second mooring line channel section 230 and a second opening 222 of a second mooring line storage section 220. For example, the second location L2 may be a location on the turret body top surface 212 between the second mooring line channel section 230 illustrated on the right hand side of FIG. 2 (or bottom of FIG. 4B) and the second opening 222 of the second mooring line storage section 220 illustrated on the right hand side of FIG. 2 (or bottom of FIG. 4B).

The transportable windlass assembly 240 may be configurable to receive and control a movement of a portion of a first mooring line 202 (e.g., the mooring line 202 illustrated on the left hand side of FIG. 2) spanning between a first opening 222 of a first mooring line storage section 220 (e.g., the mooring line storage section 220 illustrated on the left hand side of FIG. 2) and a first mooring line channel section 230 (e.g., the mooring line channel section 230 illustrated on the left hand side of FIG. 2) when the transportable windlass assembly 240 is configured to be positioned and/or secured to the turret body top surface 212 at the first location L1. More specifically, when the transportable windlass assembly 240 is configured to be positioned and/or secured to the turret body top surface 212 at the first location L1, the rotary member 244*a* of the transportable windlass assembly 240 may be configurable to receive and control the movement of the portion of the first mooring line 202 spanning between the first opening 222 and the first mooring line storage section 220 and the first mooring line channel section 230.

Similarly, when the transportable windlass assembly 240 is transported to and configured to be positioned and/or secured to the turret body top surface 212 at the second location L2 (or any other location, such as L3-L8), the transportable windlass assembly 240 may be configurable to receive and control a movement of a portion of a second mooring line 202 (e.g., the mooring line 202 illustrated on the right hand side of FIG. 2) spanning between a second opening 222 of a second mooring line storage section 220 (e.g., the mooring line storage section 220 illustrated on the right hand side of FIG. 2) and a second mooring line channel section 230 (e.g., the mooring line channel section 230 illustrated on the right hand side of FIG. 2).

In an example embodiment, the rotary member 244*a* may be configurable in such a way that, when the transportable windlass subsystem 240 is secured to the turret body top surface at the first location L1 and when the rotary member 244*a* of the transportable windlass assembly receives the first mooring line 202, the rotary member 244*a* may be operable to direct at least a portion of the first mooring line 202 into the first mooring line storage section 220 (and/or direct at least a portion of the first mooring line 202 out of the first mooring line channel section 230) by rotating in the first direction R1. Similarly, the rotary member 244*a* may be configurable in such a way that, when the transportable windlass subsystem 240 is secured to the turret body top surface at the first location L1 and when the rotary member 244*a* of the transportable windlass assembly receives the first mooring line 202, the rotary member 244*a* may be operable to direct at least a portion of the first mooring line 202 out of the first mooring line storage section 220 (and/or direct at least a portion of the first mooring line 202 into the first mooring line channel section 230) by rotating in the first direction R2.

Figure 5:
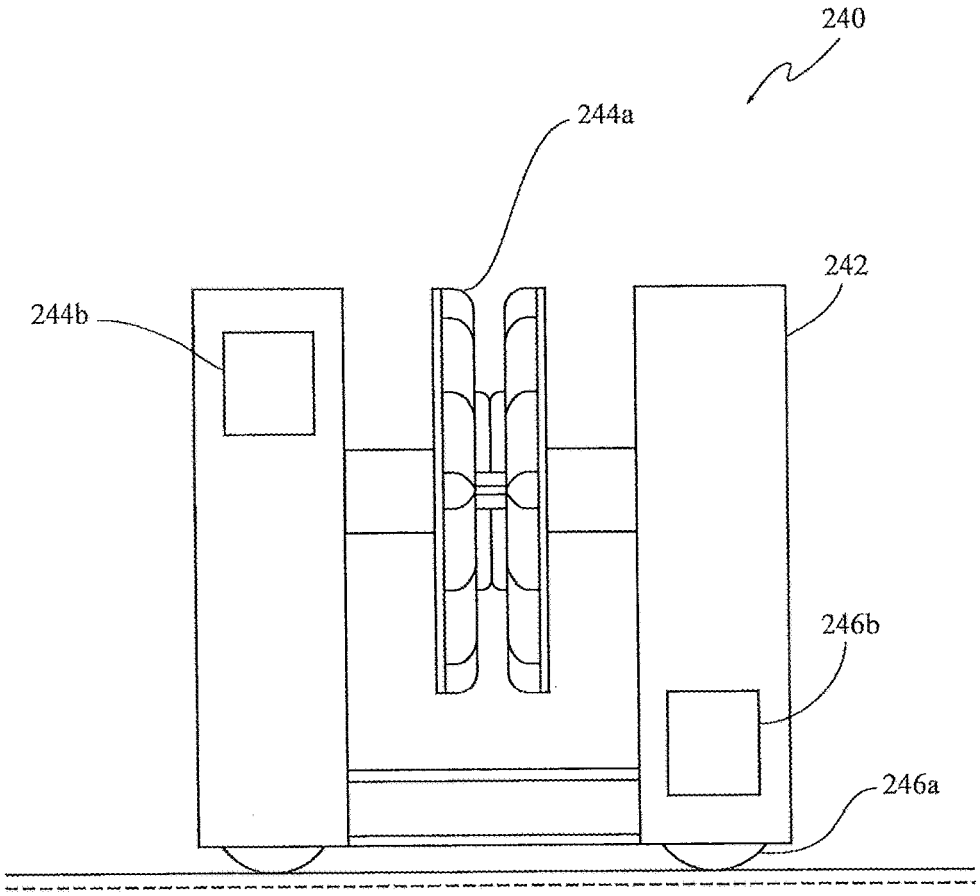
FIG. 5 is a side view of an example embodiment of a transportable windlass assembly.

The rotary member 244*a* of the transportable windlass assembly 240 may be configurable to control movement of one or more mooring lines 202 via a rotary member motor 244*b*, or the like, as illustrated in FIG. 5. In an example embodiment, the transportable windlass assembly 240 may further comprise a tension load monitoring system (not shown), or the like, for use in monitoring and measuring tension of the mooring lines, such as the first mooring line 202.

In an example embodiment, the transportable windlass assembly 240 may further comprise one or more transport mechanisms 246*a*, such as one or more wheels 246*a*, or the like, for use in transporting (or moving) the transportable windlass assembly 240 between a plurality of locations, including first location L1 and second location L2. Furthermore, the transportable windlass assembly 240 may comprise a break mechanism (not shown), or the like, for use in securing a position of the transportable windlass subsystem 240 relative to a location on the turret body 210. The one or more transport mechanisms 246*a* and/or break mechanisms of the transportable windlass assembly 240 may be configurable to transport (or move) and/or secure a position of the transportable windlass assembly 240 via a transport motor 246*b*, or the like, as illustrated in FIG. 5.

In example embodiments, the turret system 200 may comprise more than one transportable windlass assembly 240. For example, when the turret system 200 comprises eight locations L1-L8, as illustrated in FIG. 4B (i.e., eight mooring lines 202, eight mooring line channel sections 230, and/or eight mooring line storage sections 220), the turret system 200 may comprise two transportable windlass assemblies 240. In such an example, a first transportable windlass assembly 240 may be operable to be transported to locations L1, L3, L5, and L7 (i.e., control a movement of a mooring line through mooring line channel sections 230 and mooring line storage sections 220 nearby locations L1, L3, L5, and L7) and a second transportable windlass assembly 240 may be operable to be transported to locations L2, L4, L6, and L8 (i.e., control a movement of a mooring line through mooring line channel sections 230 and mooring line storage sections 220 nearby locations L2, L4, L6, and L8). Of course, in such an example, the first transportable windlass assembly 240 need not be restricted to only locations L1, L3, L5, and L7, although it may, and the second transportable windlass assembly 240 need not be restricted to only locations L2, L4, L6, and L8, although it may.

(5) Windlass Rail Assembly (e.g., Windlass Rail Assembly 250)

In an example embodiment, the turret system 200 may further comprise a windlass rail assembly (e.g., windlass rail assembly 250), or the like, as illustrated in at least FIG. 4A and FIGS. 4B, 6, 7, and 9-13. The windlass rail assembly 250 may be a rail extending between at least the first location L1 and another location L3. In example embodiments, the windlass rail assembly 250 may extend between the first location L1 and one or more of a plurality of other locations, such as one or more of locations L2-L8.

As illustrated in FIG. 4B, the windlass rail assembly 250 may be configured in a ring configuration, or the like, in example embodiments. It is to be understood in the present disclosure that the windlass rail assembly 250 may also be configured in other configurations, such as a star-shaped configuration (each location does not necessarily connect to only neighboring locations) or mesh-shaped configuration (each location may connect to more than two other locations), without departing from the teachings of the present disclosure.

The windlass rail assembly 250 may be configurable to receive one or more transportable windlass assemblies 240 in example embodiments. This is illustrated in at least FIGS. 2, 3, 4B, 5, 6, and 9-10. The windlass rail assembly 250 may also be configurable to enable one or more transportable windlass assemblies 240 to be transported, either directly or indirectly, between one or more locations, such as between location L1 and one or more of locations L2-L8.

Example embodiments of the windlass rail assembly 250 may include a pair of substantially parallel rails (as illustrated in at least FIGS. 2, 3, 4A, 4B, 5, 6, and 9-13). It is to be understood in the present disclosure that the windlass rail assembly 250 may also be in other shapes, forms, quantities, and/or configurations without departing from the teachings of the present disclosure. For example, the windlass rail assembly 250 may be in the form of a single rail, a plurality of rails, intersection of one or more rails, one or more rails with wheels, bearings, or the like. As another example, the windlass rail assembly 250 may be in the form of a groove, indentation, and/or channel in the turret body top surface 212. In yet another example, the windlass rail assembly 250 may be in the form of walls, which ensure the transportable windlass assembly 240 (i.e., transport mechanisms 246*a* of the transportable windlass assembly 240) remain in a desired path. Other example embodiments of the windlass rail assembly 250 operable to receive and enable transport of one or more transportable windlass assemblies 240 are also contemplated in the present disclosure.

(6) Fairlead Assembly (e.g., Fairlead Assembly 260)

Figure 6:
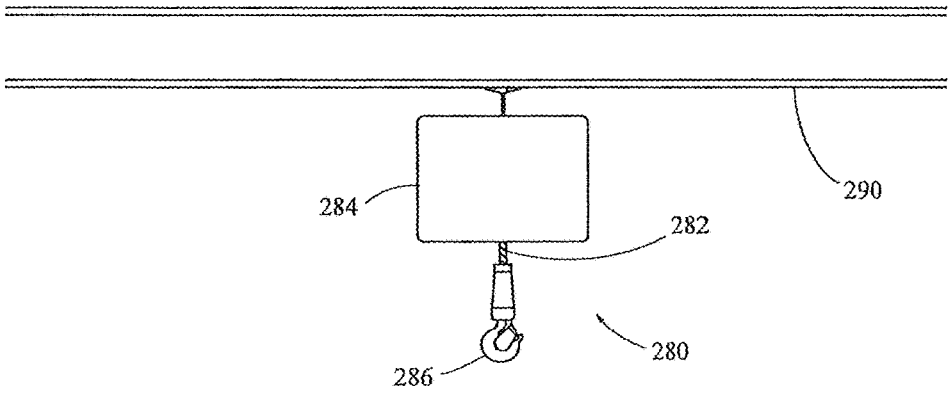
FIG. 6 is a front view of an example embodiment of a transportable windlass subsystem in operation.
Figure 6:
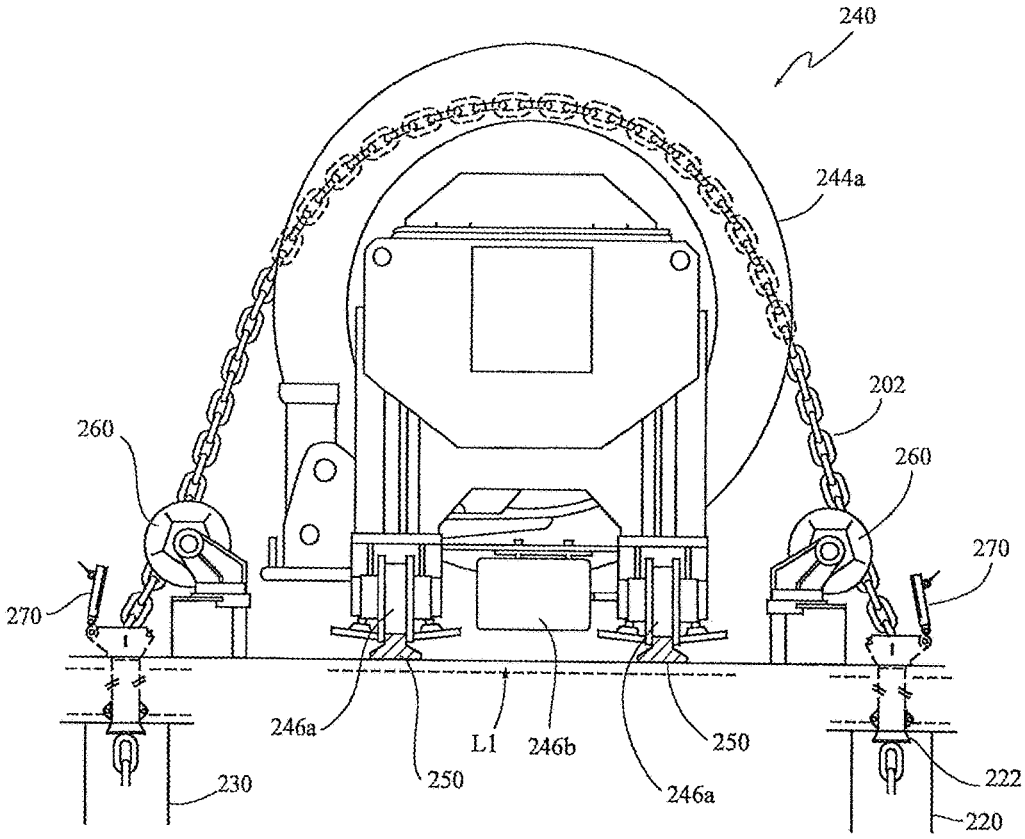
Figure 7:
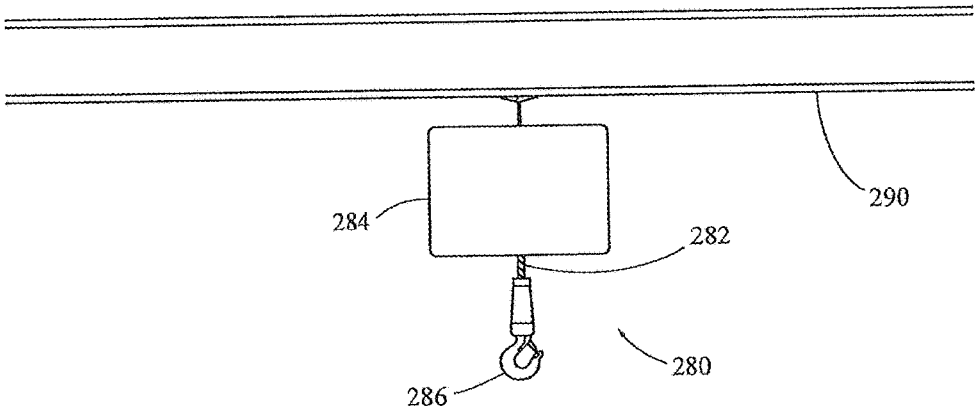
FIG. 7 is a front view of another example embodiment of a transportable windlass subsystem in operation.
Figure 7:
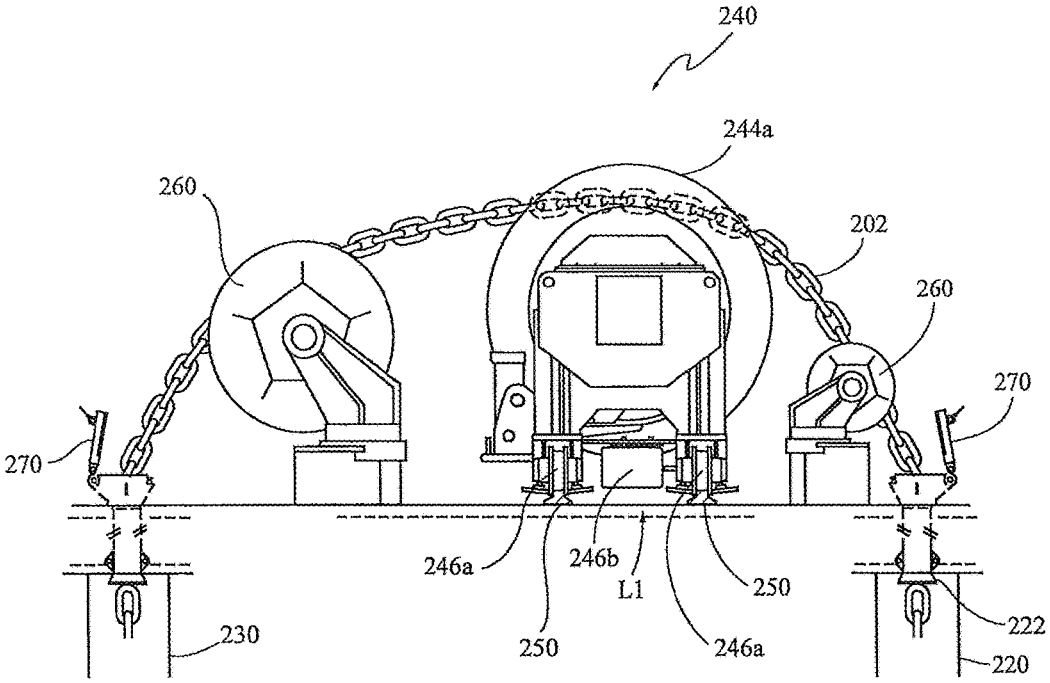
Figure 8A:
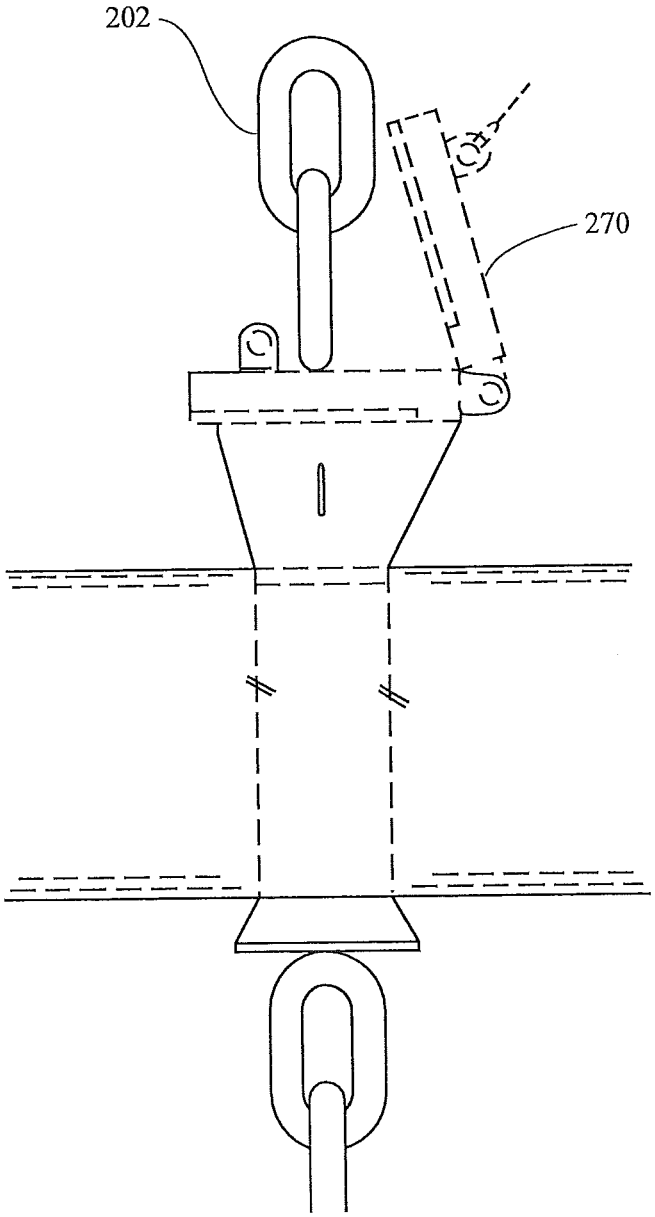
FIG. 8A is a side view of an example embodiment of a mooring line stopper assembly.
Figure 8B:
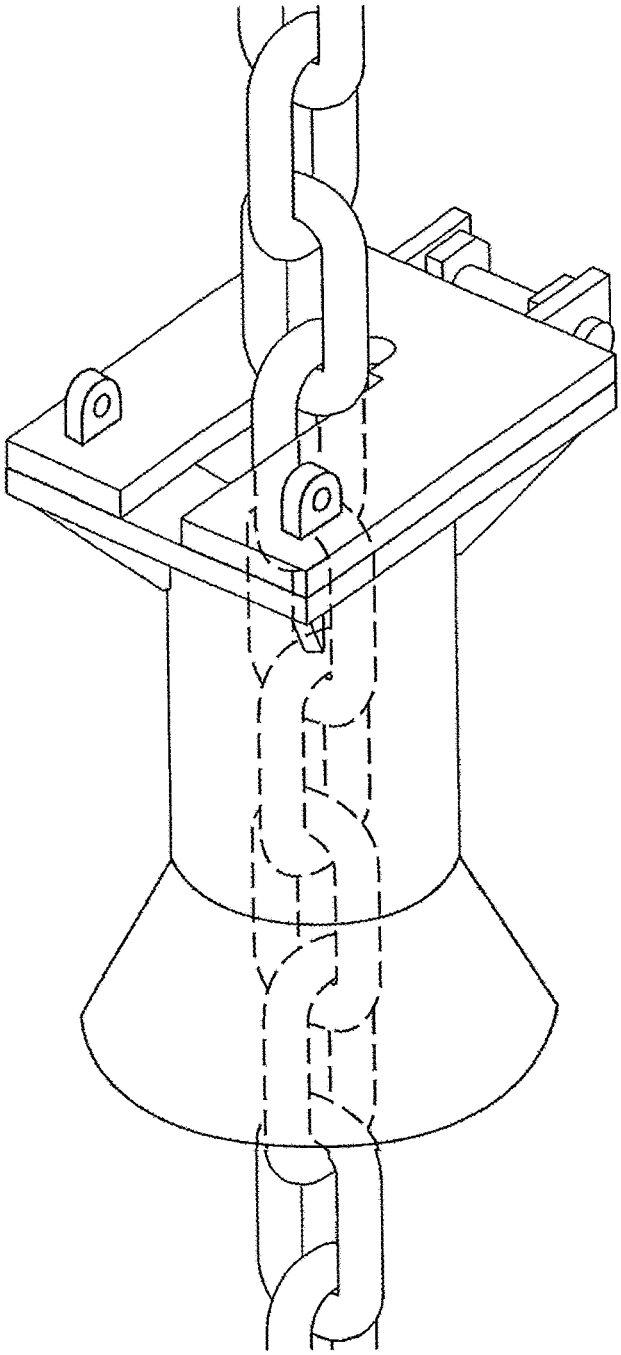
FIG. 8B is a perspective view of an example embodiment of a mooring line stopper assembly.

As illustrated in at least FIG. 6 and FIG. 7, the turret system 200 may comprise one or more fairlead assemblies (e.g. fairlead assembly 260), or the like. In an example embodiment, one or more fairlead assemblies 260 may be provided and secured to the turret body top surface 212 at a location nearby a mooring line channel section 230 (e.g., the mooring line channel section 230 illustrated on the left hand side of FIG. 6). For example, one or more fairlead assemblies 260 may be provided and secured to the turret body top surface 212 at a location between a mooring line channel section 230 (e.g., the mooring line channel section 230 illustrated on the left hand side of FIG. 6) and a first location L1 (i.e., a location on the turret body top surface 212 between a mooring line channel section 230 and a first opening 222 of a mooring line storage section 220 where a transportable windlass subsystem 240 may be positioned).

One or more other fairlead assemblies 260 may also be provided and secured to the turret body top surface 212 at a location nearby a mooring line storage section 220 (e.g., the mooring line storage section 220 illustrated on the right hand side of FIG. 6). For example, one or more fairlead assemblies 260 may be provided and secured to the turret body top surface 212 at a location between a mooring line storage section 220 (e.g., the mooring line storage section 220 illustrated on the right hand side of FIG. 6) and a first location L1 (i.e., a location on the turret body top surface 212 between a mooring line channel section 230 and a first opening 222 of a mooring line storage section 220 where a transportable windlass subsystem 240 may be positioned).

One or more of the fairlead assemblies 260 may be provided for securing to the turret body top surface 212 in one or more of a plurality of shapes, sizes, and/or configurations. For example, one or more of the fairlead assemblies 260 (e.g., the fairlead assembly 260 illustrated on the left hand side or right hand side of FIG. 6) may be in the form of a circular spool, or the like, having a size or shape (or cross-section, radius, diameter, thickness, etc.) that is relatively smaller than a rotary member 244*a* of a transportable windlass assembly 240. In another example embodiment, one or more of the fairlead assemblies 260 (e.g., the fairlead assembly 260 illustrated on the left hand side of FIG. 7) may have a size or shape (or cross-section, radius, diameter, thickness, etc.) that is approximately the same as a rotary member 244*a* of a transportable windlass assembly 240. It is to be understood in the present disclosure that other shapes, sizes, quantities, and/or configurations of the fairlead assemblies 260 are contemplated without departing from the teachings of the present disclosure.

(7) Mooring Line Stopper Assembly (e.g., Mooring Line Stopper 270)

As illustrated in at least FIGS. 6-7, FIG. 8A, FIG. 8B, and FIGS. 9-13, in an example embodiment, the turret system 200 may comprise one or more mooring line stopper assemblies (e.g., the mooring line stopper assembly 270), or the like. The one or more mooring line stopper assemblies 270 may be provided and secured to the turret body top surface 212 at a location proximate to (or nearby) a mooring line channel section 230 (e.g., the mooring line channel section 230 illustrated on the left hand side of FIG. 6). For example, one or more mooring line stopper assemblies 270 may be provided and secured to the turret body top surface 212 at a location between a mooring line channel section 230 (e.g., the mooring line channel section 230 illustrated on the left hand side of FIG. 6) and a first location L1 (i.e., a location on the turret body top surface 212 between a mooring line channel section 230 and a first opening 222 of a mooring line storage section 220 where a transportable windlass subsystem 240 may be positioned). One or more of the mooring line stopper assemblies 270 may also be provided and secured to, incorporated with, integrated with, and/or combined with one or more elements of the turret system 200 in example embodiments. For example, one or more mooring line stopper assemblies 270 may be secured to, incorporated with, integrated with, and/or combined with one or more fairlead assemblies 260 (e.g., the fairlead assembly 260 illustrated on the left hand side of FIG. 6) and/or other elements.

One or more mooring line stopper assemblies 270 may also be provided and secured to the turret body top surface 212 at a location proximate to (or nearby) a mooring line storage section 220 (e.g., the mooring line storage section 220 illustrated on the right hand side of FIG. 6). For example, one or more mooring line stopper assemblies 270 may be provided and secured to the turret body top surface 212 at a location between a mooring line storage section 220 (e.g., the mooring line storage section 220 illustrated on the right hand side of FIG. 6) and a first location L1 (i.e., a location on the turret body top surface 212 between a mooring line channel section 230 and a first opening 222 of a mooring line storage section 220 where a transportable windlass subsystem 240 may be positioned). One or more of the mooring line stopper assemblies 270 may also be provided and secured to, incorporated with, integrated with, and/or combined with one or more elements of the turret system 200, such as one or more fairlead assemblies 260 (e.g., the fairlead assembly 260 illustrated on the right hand side of FIG. 6) and/or other elements.

In an example embodiment, one or more of the mooring line stopper assemblies 270 may be configurable to receive a mooring line 202 (e.g., the mooring line illustrated in at least FIGS. 6-7 and FIGS. 9-13). The one or more mooring line stopper assemblies 270 may also be configurable to actuate, manually and/or via a motor and/or controller (not shown), to and/or between at least a stop position and a release position.

As illustrated by the mooring line stopper assembly 270 on the left hand side of at least FIG. 9, FIG. 10, FIG. 11, FIG. 12, and FIG. 13, when a mooring line stopper assembly 270 receives a mooring line 202 and when the mooring line stopper assembly 270 is actuated to the stop position, the mooring line stopper assembly 270 may be operable to restrict (or stop or control) a movement of the mooring line 202 through the mooring line channel section 230. Furthermore, as illustrated by the mooring line stopper assembly 270 on the left hand side of at least FIGS. 6-7, when a mooring line stopper assembly 270 is actuated to the release position, the mooring line stopper assembly 270 may be operable to allow a movement of the mooring line 202 through the mooring line channel section 230.

Figure 12:
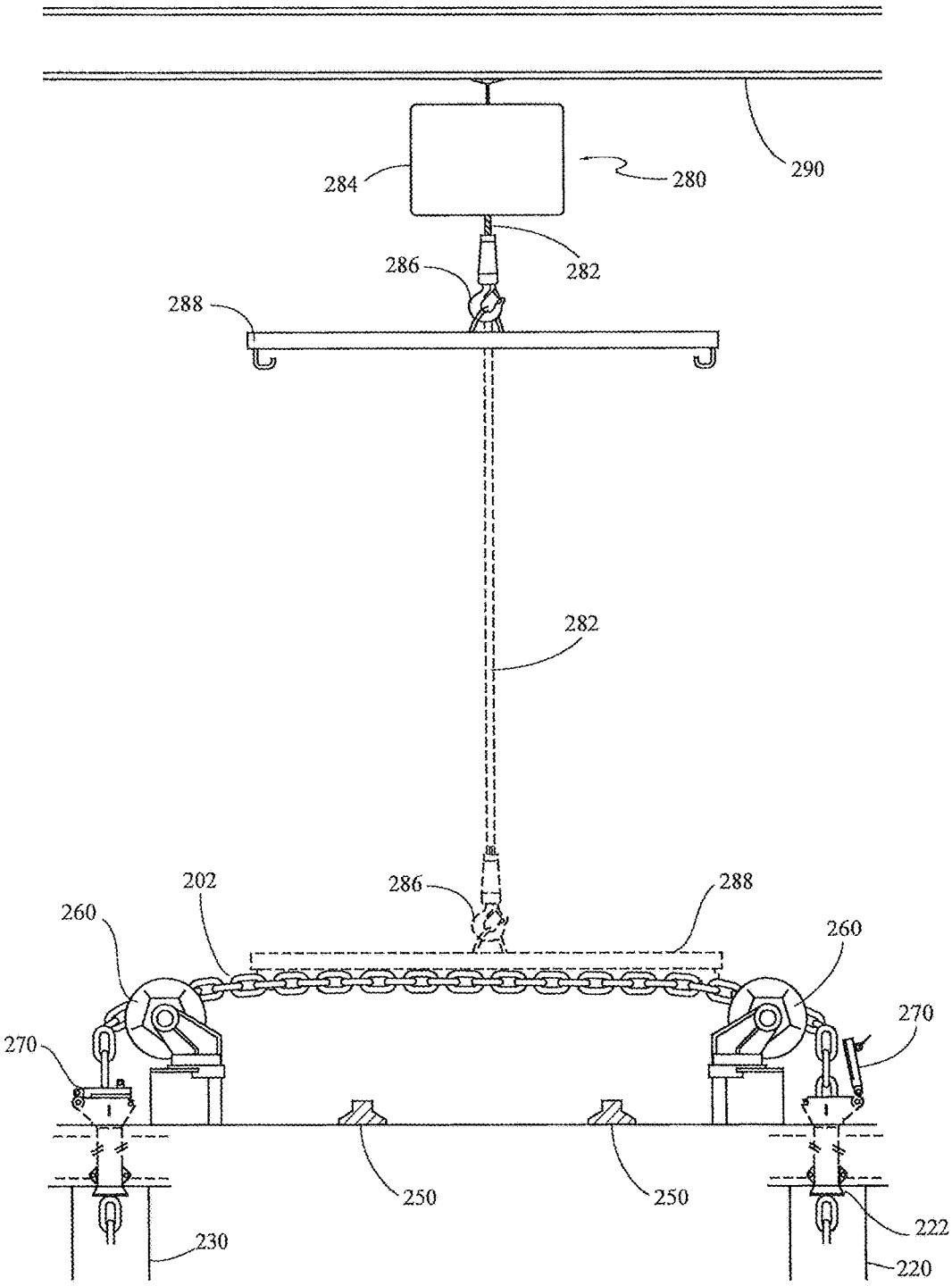
FIG. 12 is another front view of an example embodiment of a hoisting assembly in operation.
Figure 13:
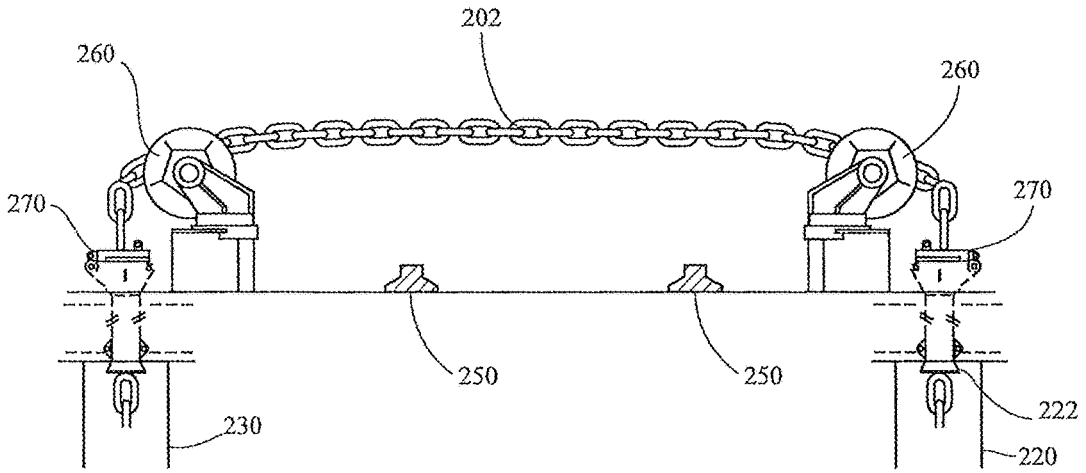
FIG. 13 is a front view of an example embodiment of the mooring line stopper assemblies, fairlead assemblies, mooring line storage section, mooring line channel section, windlass rail assembly, and mooring chain.

As illustrated by the mooring line stopper assembly 270 on the right hand side of FIG. 13, when a mooring line stopper assembly 270 receives a mooring line 202 and when the mooring line stopper assembly 270 is actuated to the stop position, the mooring line stopper assembly 270 may be operable to restrict (or stop or control) a movement of the mooring line 202 through the mooring line storage section 220. Furthermore, as illustrated by the mooring line stopper assembly 270 on the right hand side of at least FIGS. 6-7 and FIGS. 9-12, when a mooring line stopper assembly 270 is actuated to the release position, the mooring line stopper assembly 270 may be operable to allow a movement of the mooring line 202 through the mooring line storage section 220.

It is to be understood in the present disclosure that the one or more mooring line stopper assemblies 270 may be provided in one or more of a plurality of shapes, sizes, quantities, and/or configurations. For example, the one or more mooring line stopper assemblies 270 may be in the form of a U-shaped protrusion, or the like, for use in contacting with and/or holding an exterior portion of one or more links of a mooring chain 202. As another example, the one or more mooring line stopper assemblies 270 may be in the form of an elongated protrusion, or the like, for use in inserting into an interior portion of one or more links of a mooring chain 202. It is to be understood in the present disclosure that other shapes, sizes, quantities, and/or configurations of the mooring line stopper assemblies 270 are contemplated without departing from the teachings of the present disclosure.

(8) Hoisting Assembly (e.g., Hoisting Assembly 280)

In an example embodiment, as illustrated in at least FIGS. 2, 4A, 6, and 9-12, the turret system 200 may comprise a hoisting assembly (e.g., hoisting assembly 280), or the like. The hoisting assembly 280 may be configurable to be positioned in one or more of a plurality of locations. In an example embodiment, the hoisting assembly 280 may be configurable in such a way that, when the hoisting assembly 280 is positioned at a location above (or proximate or nearby) a first location L1 (i.e., a location on the turret body top surface 212 between a mooring line channel section 230 and a first opening 222 of a mooring line storage section 220 where a transportable windlass subsystem 240 may be positioned), the hoisting assembly 280 may be operable to control (such as restrict, hold, move, position, change, etc.) at least a position of a mooring line 202 (e.g., the mooring line illustrated in at least FIGS. 6-7 and FIGS. 9-13). For example, the hoisting assembly 280 may be configurable in such a way that, when the hoisting assembly 280 is positioned at a location above the first location L1, the hoisting assembly 280 may be operable to control at least a position of a portion of the mooring line 202 spanning between a mooring line storage section 220 (e.g., the mooring line storage section 220 illustrated on the right hand side of at least FIGS. 6-7 and FIGS. 9-13) and the mooring line channel section 230 (e.g., the mooring line channel section 230 illustrated on the left hand side of at least FIGS. 6-7 and FIGS. 9-13).

The hoisting assembly 280 may comprise one or more chains 282, sling wire, and/or the like, extendable from and retractable to the main body 284 of the hoisting assembly 280. The hoisting assembly 280 may be operable to perform such extending and/o retracting of the one or more chains 282 by receiving manual manipulation from an operator and/or via a motor, controller, and/or the like. Operations of the hoisting assembly 280 may be controllable manually by an operator or automatically/remotely via a controller (not shown). The hoisting assembly 280 may comprise a hook, protrusion, magnet, or the like, (hereinafter "hoisting attachment member") 286 attached to the one or more chains 282 for use in receiving, securing, and/or attaching to a portion of a mooring line 202. In an example embodiment, the hoisting assembly 280 may further comprise a hoisting attachment portion 288 having a plurality of hoisting attachment members, or the like, in addition to (i.e., connected to) or in replacement of the hoisting attachment member 286 referred to above.

When not in use, the hoisting assembly 280 may be configured in a retracted position, such as the example embodiment illustrated in FIGS. 6 and 7. The hoisting assembly 280 may be configured to be transportable between a plurality of locations, such as between one or more locations above one or more of the locations L1-L8.

Figure 9:
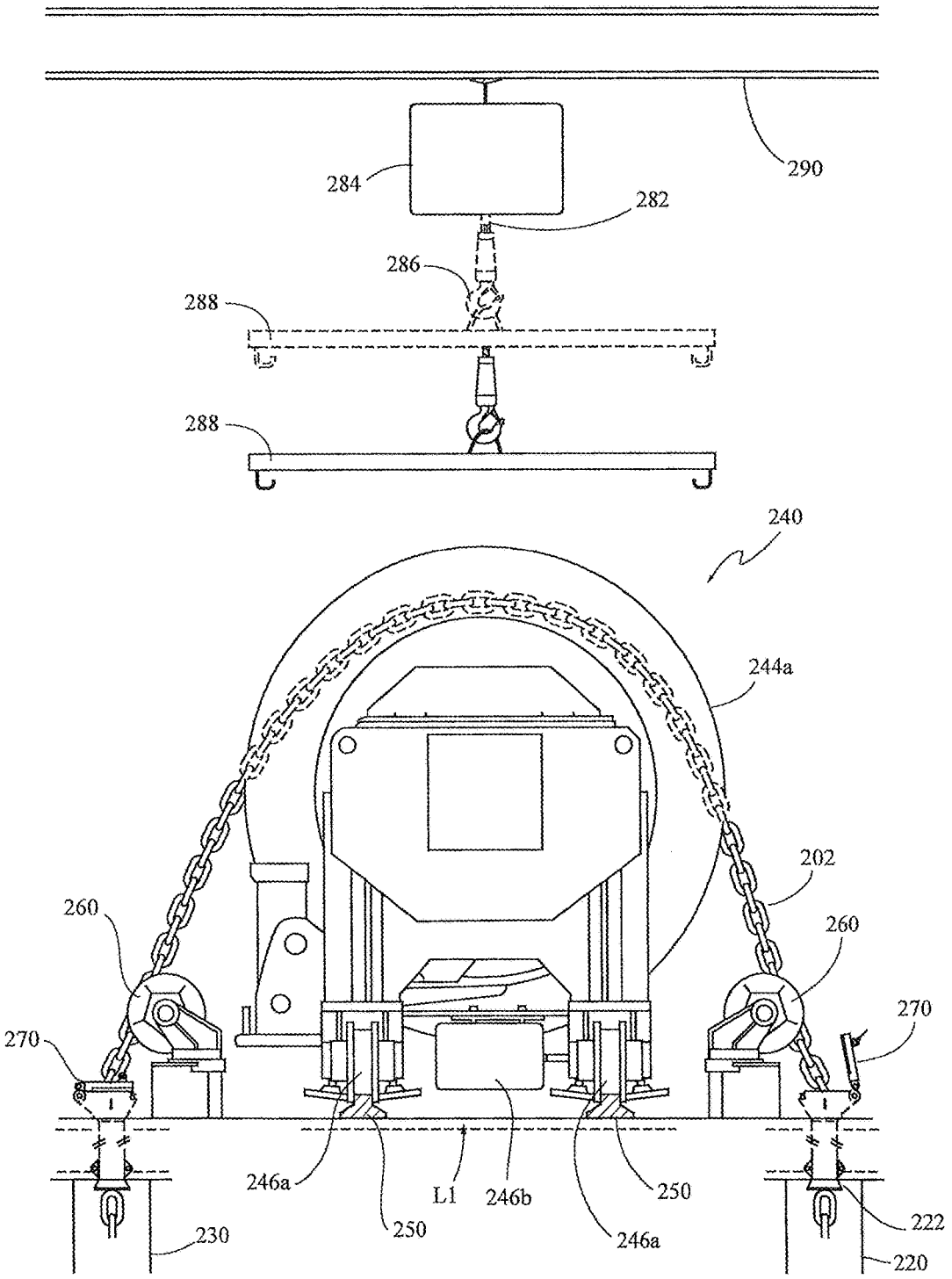
FIG. 9 is a front view of an example embodiment of a transportable windlass subsystem and a hoisting assembly in operation.

In operation, the hoisting assembly 280 may be configurable to extend (or un-retract) the one or more chains 282 of the hoisting assembly 280 so as to enable the hoisting attachment member 286 and/or hoisting attachment portion 288 to be lowered (or moved) towards a transportable windlass assembly 240, as illustrated in FIG. 9. Although FIG. 9 illustrates the hoisting attachment portion 288 being used, it is to be understood in the present disclosure that the hoisting attachment member 286 may also be used alone without departing from the teachings of the present disclosure. Prior to doing so, one or more mooring line stopper assemblies 270, such as those proximate to (or nearby) the mooring line channel section 230 (e.g., the mooring line channel section 230 illustrated on the left hand side of at least FIG. 9), may be configured to be in the stop position. It is recognized in the present disclosure that doing so enables a length and tension of the mooring line 202 (e.g., the section of the mooring line 202 between the mooring line stopper assembly 270 and an anchor 204 anchored to a bottom of a body of water) to be maintained.

Figure 10:
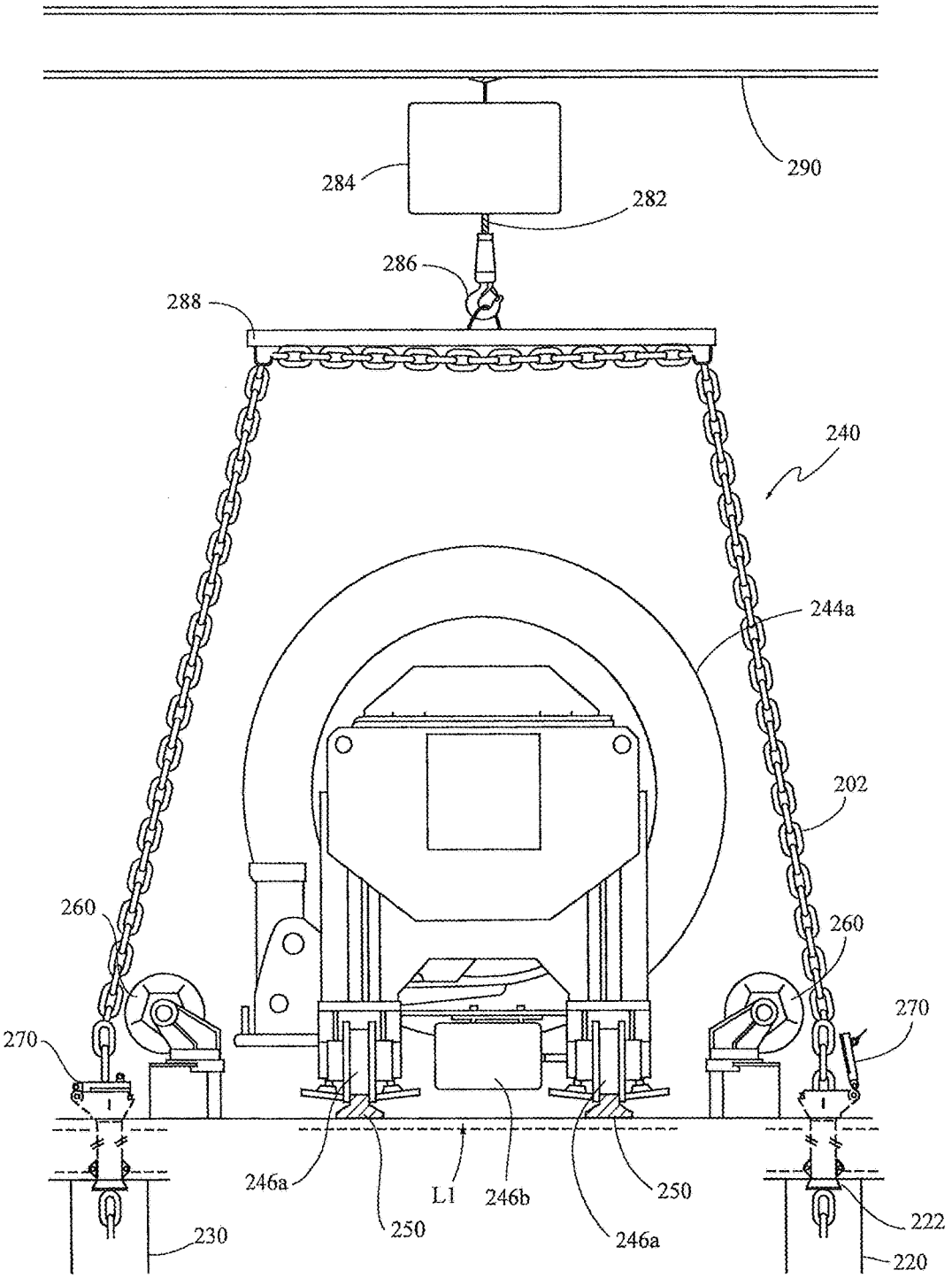
FIG. 10 is another front view of an example embodiment of a transportable windlass subsystem and a hoisting assembly in operation.
Figure 11:
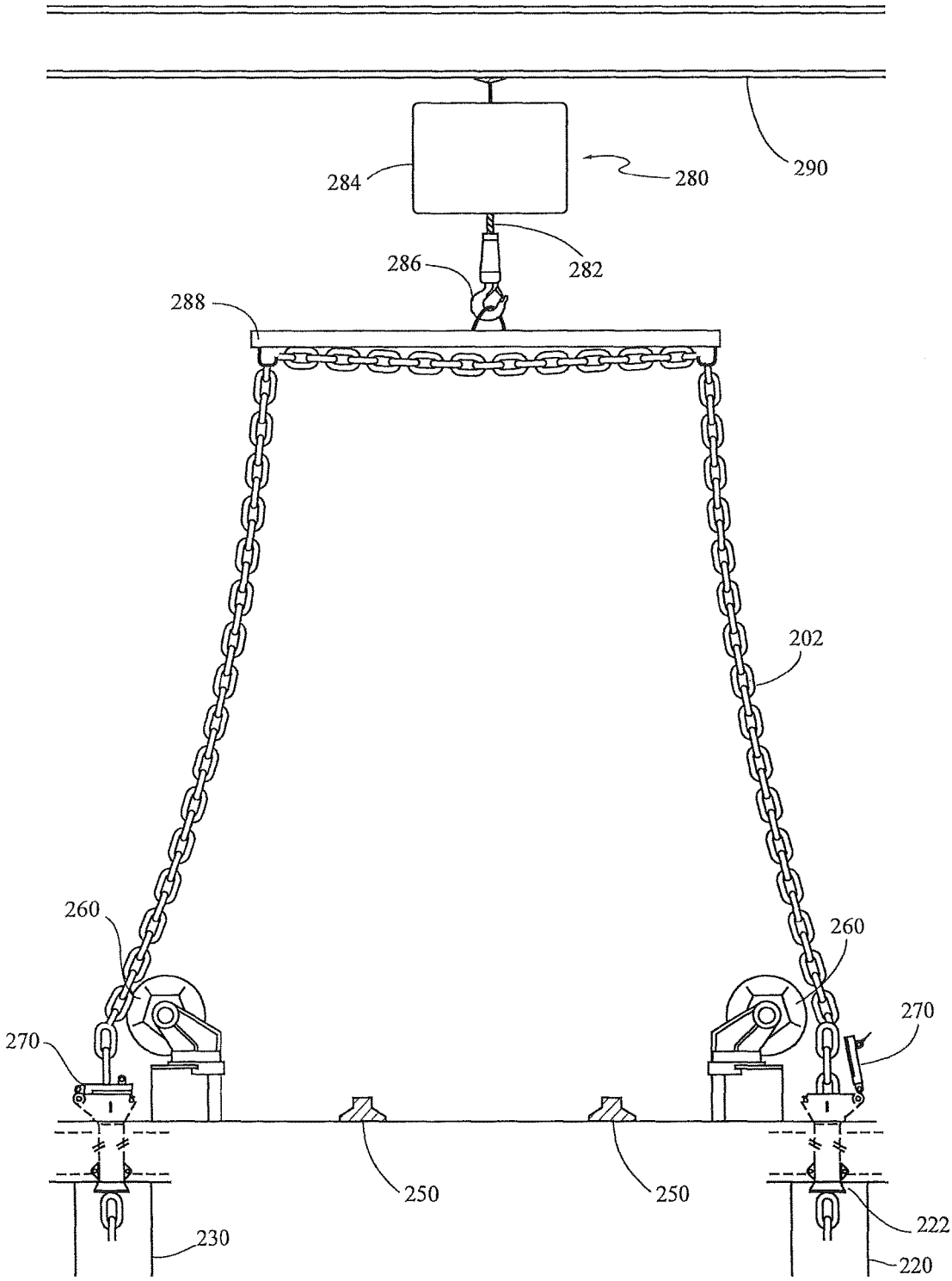
FIG. 11 is a front view of an example embodiment of a hoisting assembly in operation.

The hoisting attachment portion 288 may then be configured to receive (or hook to, attach to, or secure to; hereinafter "receive") the mooring line 202. Once received, the hoisting attachment portion 288 may be configured to retract the one or more chains 282 so as to control a position of the mooring line 202. For example, as illustrated in FIG. 10, when the transportable windlass assembly 240 is positioned at location L1 and the transportable windlass assembly 240 is no longer in use and/or needed at location L1, the hoisting attachment portion 288 may be configured to retract the one or more chains 282 so as to lift (or move) the mooring line 202 away from the transportable windlass assembly 240. In this regard, the transportable windlass assembly 240 may then be transported to another location, such as one of locations L2-L8, as illustrated by the absence of the transportable windlass assembly 240 in FIG. 11.

Thereafter, the hoisting assembly 280 may be configurable to extend (or release) the one or more chains 282 so as to release the control of the position of the mooring line 202. For example, as illustrated in FIG. 12, when the transportable windlass assembly 240 is transported away from location L1, the hoisting attachment portion 288 may be configured to extend (or release) the one or more chains 282 so as to allow the mooring line 202 to be lowered (or moved) towards the turret body top surface 212. In this regard, the excess portions of the mooring line 202 from the extending (or releasing) of the one or more chains 282 may be stored in the mooring line storage section 220.

The hoisting assembly 280 may then be configured to retract the one or more chains 282, as illustrated in FIG. 12. Furthermore, the one or more mooring line stopper assemblies 270, such as those nearby the mooring line storage section 220 (e.g., the mooring line storage section 220 illustrated on the right hand side of at least FIG. 13), may be configured to be in the stop position, as illustrated in FIG. 13. It is recognized in the present disclosure that actuating the one or more mooring line stopper assemblies 270 nearby the mooring line channel section 230 (e.g., the mooring line channel section 230 illustrated on the left hand side of at least FIG. 13) and actuating the one or more mooring line stopper assemblies 270 nearby the mooring line storage section 220 (e.g., the mooring line storage section 220 illustrated on the right hand side of at least FIG. 13) enables the mooring line 202 to sufficiently secure the vessel 100 to the bottom of the body of water (via anchor 204), which enables a length and tension of the mooring line (e.g., the section of the mooring line 202 between the mooring line stopper assembly 270 and an anchor 204 anchored to a bottom of a body of water) to be maintained.

(9) Hoisting Rail Assembly (e.g., Hoisting Rail Assembly 290)

In an example embodiment, the turret system 200 may further comprise a hoisting rail assembly (e.g., hoisting rail assembly 290), or the like, as illustrated in at least FIGS. 4A, 6, 7, and 9-12. The hoisting rail assembly 290 may be a rail extending between at least an area proximate to (or nearby) the first location L1 and an area proximate to (or nearby) another location L3. For example, the hoisting rail assembly 290 may be a rail extending between an area above the first location L1 and an area above the location L3. In example embodiments, the hoisting rail assembly 290 may extend between the area proximate to (or nearby) the first location L1 and an area proximate to (or nearby) one or more of a plurality of other locations, such as one or more of locations L2-L8.

Referring to the configuration of elements of the turret system 200 in FIG. 4B, the hoisting rail assembly 290 may be configured in a ring configuration, or the like, in a similar manner as the windlass rail assembly 250 shown in FIG. 4B in example embodiments. It is to be understood in the present disclosure that the hoisting rail assembly 290 may also be configured in other configurations, such as a star-shaped configuration (each location does not necessarily connect to only neighboring locations) or mesh-shaped configuration (each location may connect to more than two other locations), without departing from the teachings of the present disclosure.

The hoisting rail assembly 290 may be configurable to receive one or more hoisting assemblies 280 in example embodiments. This is illustrated in at least FIGS. 2, 4A, 6, and 9-12. The hoisting rail assembly 290 may also be configurable to enable one or more hoisting assemblies 280 to be transported, either directly or indirectly, between one or more locations, such as between location L1 and one or more of locations L2-L8.

Example embodiments of the hoisting rail assembly 290 may include a single rail (as illustrated in at least FIGS. 2, 4A, 6, and 9-12). It is to be understood in the present disclosure that the hoisting rail assembly 290 may also be in other shapes, forms, quantities, and/or configurations without departing from the teachings of the present disclosure. For example, the hoisting rail assembly 290 may be in the form of a pair of parallel rails, a plurality of rails, intersection of one or more rails, one or more rails with wheels, bearings, or the like. As another example, the hoisting rail assembly 290 may be in the form of a groove, indentation, and/or channel in the turret body top surface 212 and/or one or more rails running parallel to the windlass rail assembly 250. Other example embodiments of the hoisting rail assembly 290 operable to receive and enable transport of one or more hoisting assemblies 280 are also contemplated in the present disclosure.

While various embodiments in accordance with the disclosed principles have been described above, it should be understood that they have been presented by way of example only, and are not limiting. Thus, the breadth and scope of the example embodiments described in the present disclosure should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

For example, as referred to herein, a controller may be any computing device or communication device, and may include a virtual machine, computer, node, instance, host, or machine in a networked computing environment. Also as referred to herein, a network or cloud may be a collection of machines connected by communication channels that facilitate communications between machines and allow for machines to share resources. Network may also refer to a communication medium between processes on the same machine. Also as referred to herein, a network element, node, or server may be a machine deployed to execute a program operating as a socket listener and may include software instances.

For example, "assembly", "apparatus", "portion", "segment", "member", "body", "section", "subsystem", "system", or other similar terms should generally be construed broadly to include one part or more than one part attached or connected together.

Memory (or storage or database) may comprise any collection and arrangement of volatile and/or non-volatile components suitable for storing data. For example, memory may comprise random access memory (RAM) devices, read-only memory (ROM) devices, magnetic storage devices, optical storage devices, and/or any other suitable data storage devices. In particular embodiments, memory may represent, in part, computer-readable storage media on which computer instructions and/or logic are encoded. Memory may represent any number of memory components within, local to, and/or accessible by a processor.

Various terms used herein have special meanings within the present technical field. Whether a particular term should be construed as such a "term of art" depends on the context in which that term is used. For example, "connect", "connected", "connecting", "connectable", "attach", "attached", "attaching", "attachable", "secure", "secured", "securing", "securable", "lock", "locked", "locking", "lockable", "anchor", "anchored", "anchoring", "anchorable", "install", "installed", "installing", "installable", "couple", "coupled", "coupling", "in communication with", "communicating with", "associated with", "associating with", or other similar terms should generally be construed broadly to include situations where attachments, connections, installations, and anchoring are direct between referenced elements or through one or more intermediaries between the referenced elements. As another example, "un-connect," "un-connected", "un-connecting", "un-connectable", "un-attach", "un-attached", "un-attaching", "un-attachable", "un-secure", "un-secured", "un-securing", "un-securable", "unlock", "unlocked", "unlocking", "unlockable", "un-anchor", "un-anchored", "un-anchoring", "un-anchorable", "uninstall", "uninstalled", "uninstalling", "uninstallable", "uncouple", "uncoupled", "uncoupling", or other similar terms should generally be construed broadly to include situations where separation, removal, and detaching are direct between referenced elements or from one or more intermediaries between the referenced elements. These and other terms are to be construed in light of the context in which they are used in the present disclosure and as one of ordinary skill in the art would understand those terms in the disclosed context. The above definitions are not exclusive of other meanings that might be imparted to those terms based on the disclosed context.

Words of comparison, measurement, and timing such as "at the time", "equivalent", "during", "complete", and the like should be understood to mean "substantially at the time", "substantially equivalent", "substantially during", "substantially complete", etc., where "substantially" means that such comparisons, measurements, and timings are practicable to accomplish the implicitly or expressly stated desired result.

Additionally, the section headings and topic headings herein are provided for consistency with the suggestions under various patent regulations and practice, or otherwise to provide organizational cues. These headings shall not limit or characterize the embodiments set out in any claims that may issue from this disclosure. Specifically, a description of a technology in the "Background" is not to be construed as an admission that technology is prior art to any embodiments in this disclosure. Furthermore, any reference in this disclosure to "invention" in the singular should not be used to argue that there is only a single point of novelty in this disclosure. Multiple inventions may be set forth according to the limitations of the claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. A turret system for use in a floating vessel, the floating vessel having a hull and a moon pool opening, the turret system comprising:

a turret body fixedly positionable in the moon pool opening and rotatable about a center axis defined by the moon pool opening, the turret body having:

a top surface;

a bottom surface opposite to the top surface;

a first mooring line storage section, the first mooring line storage section including a first opening in the turret body top surface and a first cavity formed between the turret body top surface and turret body bottom surface, wherein the first opening is operable to receive a first mooring line, and wherein the first cavity is operable to house at least a majority length of the first mooring line;

a first mooring line channel section formed through the turret body between the turret body top surface and turret body bottom surface, the first mooring line channel section being an elongated passageway for the first mooring line to pass between an exterior of the floating vessel and the first mooring line storage section;

a second mooring line storage section, the second mooring line storage section including a second opening in the turret body top surface and a second cavity formed between the turret body top surface and turret body bottom surface, wherein the second opening is operable to receive a second mooring line, and wherein the second cavity is operable to house at least a majority length of the second mooring line; and a second mooring line channel section formed through the turret body between the turret body top surface and turret body bottom surface, the second mooring line channel section being an elongated passageway for the second mooring line to pass between an exterior of the floating vessel and the second mooring line storage section, wherein the first and second mooring line channel sections are separate elongated passageways so as to enable the first mooring line and second mooring line, respectively, to be directed through the turret body to the exterior of the floating vessel without coming into contact with one another; and a transportable windlass subsystem having a rotatable member configurable to rotate in a first direction and a second direction opposite to the first direction, the transportable windlass system configurable to be securable to and transportable between a plurality of locations of the turret body.

2. The turret system of claim 1, wherein the transportable windlass subsystem is configurable to be secured at and transportable between a first location and a second location;

wherein the first location is a location between the first mooring line channel section and the first opening of the first mooring line storage section;

wherein the second location is a location between the second mooring line channel section and the second opening of the second mooring line storage section;

wherein, when the transportable windlass assembly is configured to be secured at the first location, the transportable windlass assembly is configurable to receive and control a movement of a portion of the first mooring line between the first opening of the first mooring line storage section and the first mooring line channel section; and wherein, when the transportable windlass assembly is configured to be secured at the second location, the transportable windlass assembly is configurable to receive and control a movement of a portion of the second mooring line between the second opening of the second mooring line storage section and the second mooring line channel section.

3. The turret system of claim 1, wherein the transportable windlass subsystem includes only one rotary member;

wherein the rotary member is configurable in such a way that, when the transportable windlass assembly is secured at the first location and when the transportable windlass assembly receives the first mooring line, the rotary member is operable to:

direct at least a portion of the first mooring line into the first mooring line storage section by rotating in the first direction; and direct at least a portion of the first mooring line out of the first mooring line storage section by rotating in the second direction.

4. The turret system of claim 1, further comprising:

a first fairlead assembly secured to the turret body at a location between the first mooring line channel section and the first location, the first fairlead assembly operable to guide the first mooring line between the first mooring line channel section and the first mooring line storage section; and a second fairlead assembly secured to the turret body at a location between the second mooring line channel section and the second location, the second fairlead assembly operable to guide the second mooring line between the second mooring line channel section and the second mooring line storage section;

wherein the first fairlead assembly is configurable in such a way that, when the transportable windlass assembly is configured to be secured at the first location and when the transportable windlass assembly receives the first mooring line, the first fairlead assembly is operable to guide the first mooring line between the first mooring line channel section and the transportable windlass assembly; and wherein the second fairlead assembly is configurable in such a way that, when the transportable windlass assembly is configured to be secured at the second location and when the transportable windlass assembly receives the second mooring line, the second fairlead assembly is operable to guide the second mooring line between the second mooring line channel section and the transportable windlass assembly.

5. The turret system of claim 1, further comprising:

a first front mooring line stopper assembly operable to receive the first mooring line, the first front mooring line stopper assembly actuatable between a stop position and a release position; and a first rear mooring line stopper assembly operable to receive the first mooring line, the first rear mooring line stopper assembly separate from the first front mooring line stopper assembly, the first rear mooring line stopper assembly actuatable between a stop position and a release position;

wherein, when the first front mooring line stopper assembly receives the first mooring line and when the first front mooring line stopper assembly is actuated to its stop position, the first front mooring line stopper assembly is operable to restrict a movement of the first mooring line through the first mooring line channel section;

wherein, when the first front mooring line stopper assembly is actuated to the its release position, the first front mooring line stopper assembly is operable to allow a movement of the first mooring line through the first mooring line channel section;

wherein, when the first rear mooring line stopper assembly receives the first mooring line and when the first rear mooring line stopper assembly is actuated to its stop position, the first rear mooring line stopper assembly is operable to restrict a movement of the first mooring line through the first opening of the first mooring line storage section; and wherein, when the first rear mooring line stopper assembly is actuated to the its release position, the first rear mooring line stopper assembly is operable to allow a movement of the first mooring line through the first opening of the first mooring line storage section.

6. The turret system of claim 1, further comprising:

a second front mooring line stopper assembly operable to receive the second mooring line, the second front mooring line stopper assembly actuatable between a stop position and a release position; and a second rear mooring line stopper assembly operable to receive the second mooring line, the second rear mooring line stopper assembly separate from the front second mooring line stopper assembly, the second rear mooring line stopper assembly actuatable between a stop position and a release position;

wherein, when the second front mooring line stopper assembly receives the second mooring line and when the second front mooring line stopper is actuated to its stop position, the second front mooring line stopper assembly is operable to restrict a movement of the second mooring line through the second mooring line channel section;

wherein, when the second front mooring line stopper assembly is actuated to its release position, the second front mooring line stopper assembly is operable to allow a movement of the second mooring line through the second mooring line channel section;

wherein, when the second rear mooring line stopper assembly receives the second mooring line and when the second rear mooring line stopper assembly is actuated to its stop position, the second rear mooring line stopper assembly is operable to restrict a movement of the second mooring line through the second opening of the second mooring line storage section; and wherein, when the second rear mooring line stopper assembly is actuated to its release position, the second rear mooring line stopper assembly is operable to allow a movement of the second mooring line through the second opening of the second mooring line storage section.

7. The turret system of claim 1, further comprising a windlass rail assembly;

wherein the windlass rail assembly is a rail extending between at least the first location and the second location; and wherein the windlass rail assembly is operable to receive the transportable windlass assembly and enable the transportable windlass assembly to be transported between at least the first location and the second location.

8. The turret system of claim 7, further comprising:

a plurality of other mooring line storage sections, including a third mooring line storage section, each of the plurality of other mooring line storage sections having an opening and a cavity formed between the turret body top surface and turret body bottom surface; and a plurality of other mooring line channel sections, including a third mooring line channel section, each of the plurality of other mooring line channel sections being an elongated passageway for one of a plurality of other mooring lines to pass between an exterior of the floating vessel and the one of the plurality of mooring line storage sections, each of the plurality of other mooring line channel sections formed through the turret body between the turret body top surface and turret body bottom surface;

wherein the windlass rail assembly further extends to a plurality of other locations, including at least a third location being a location between the third mooring line storage section and the third mooring line channel section; and wherein the windlass rail assembly is operable to enable the transportable windlass assembly to be transported between at least the first location, the second location, and the third location.

9. The turret system of claim 1, further comprising a hoisting assembly;

wherein the hoisting assembly is configurable in such a way that, when the hoisting assembly is positioned at a location above the first location, the hoisting assembly is operable to control at least a position of a portion of the first mooring line spanning between the first mooring line storage section and the first mooring line channel section;

wherein the hoisting assembly is configurable in such a way that, when the hoisting assembly is positioned at a location above the second location, the hoisting assembly is operable to control at least a position of a portion of the second mooring line spanning between the second mooring line storage section and the second mooring line channel section;

wherein the hoisting assembly is configurable in such a way that, when the hoisting assembly is positioned at the location above the first location, the hoisting assembly is operable to move a portion of the first mooring line spanning between the first mooring line storage section and the first mooring line channel section away from the turret body top surface; and wherein the hoisting assembly is configurable in such a way that, when the hoisting assembly is positioned at the location above the second location, the hoisting assembly is operable to move a portion of the second mooring line spanning between the second mooring line storage section and the second mooring line channel section away from the turret body top surface.

10. The turret system of claim 9, wherein the hoisting assembly is configurable in such a way that, when the hoisting assembly is positioned at the location above the first location and when the portion of the first mooring line spanning between the first mooring line storage section and the first mooring line channel section is moved by the hoisting assembly to be away from the turret body top surface, the hoisting assembly is operable to control the position of the first mooring line so as to be received by the transportable windlass subsystem when the transportable windlass subsystem is transported to the first position;

wherein the hoisting assembly is configurable in such a way that, when the hoisting assembly is positioned at the location above the second location and when the portion of the second mooring line spanning between the second mooring line storage section and the second mooring line channel section is moved by the hoisting assembly to be away from the turret body top surface, the hoisting assembly is operable to control the position of the second mooring line so as to be received by the transportable windlass subsystem when the transportable windlass subsystem is transported to the second position;

wherein the hoisting assembly is configurable in such a way that, when the transportable windlass subsystem is positioned at the first position and when the first mooring line is received by the transportable windlass subsystem, the hoisting assembly is operable to control the position of the first mooring line so as to be removed from the transportable windlass subsystem; and wherein the hoisting assembly is configurable in such a way that, when the transportable windlass subsystem is positioned at the second position and when the second mooring line is received by the transportable windlass subsystem, the hoisting assembly is operable to control the position of the second mooring line so as to be removed from the transportable windlass subsystem.

11. The turret system of claim 9, further comprising a hoisting rail assembly, the hoisting rail assembly being a rail extending between at least the location above the first location and the location above the second location, the hoisting rail assembly operable to receive the hoisting assembly and enable the hoisting assembly to be transported between at least the location above the first location and the location above the second location.

12. The turret system of claim 1, further comprising a second transportable windlass assembly;

wherein the second transportable windlass assembly is configured to be securable to and transportable between a plurality of locations on the top surface of the turret body, including the first location and the second location;

wherein the second transportable windlass assembly comprises a second rotary member configurable to rotate in the first direction and the second direction; and wherein the second rotary member is configurable in such a way that, when the second transportable windlass assembly is secured at the first location and when the second transportable windlass assembly receives the first mooring line, the second rotary member is operable to:

direct at least a portion of the first mooring line into the first mooring line storage section by rotating in the first direction; and direct at least a portion of the first mooring line out of the first mooring line storage section by rotating in the second direction.

13. The turret system of claim 1, further comprising a controller in communication with the transportable windlass assembly, wherein the controller is operable to perform one or more of the following:

control the rotation of the rotary member;

configure the transportable windlass assembly to variably adjust a tension of the first mooring line when the transportable windlass assembly is configured to be secured at the first location and when a first end of the first mooring line is secured to a bottom of a body of water via an anchor; and/or control the movement of the transportable windlass assembly between the first position and the second position;

wherein the controller configures the transportable windlass assembly to variably adjust the tension of the first mooring line based on a predetermined load/force calculation.

14. A windlass assembly for use in a turret system of a floating vessel, the turret system having a turret body positioned in a moon pool opening and rotatable about a center axis defined by the moon pool opening, the turret body having a mooring line storage section and a mooring line channel section, the mooring line storage section including a first opening and a first cavity, the first opening operable to receive a mooring line, the mooring line channel section being an elongated passageway for the mooring line to pass between an exterior of the floating vessel and the mooring line storage section, the windlass assembly comprising:

a transportable windlass subsystem, the transportable windlass subsystem configured to be transportable between a plurality of locations on a top surface of the turret body, including a first location, wherein the transportable windlass subsystem is configurable to receive and control a movement of a portion of a mooring line; and a hoisting assembly, the hoisting assembly configurable to be transportable between a plurality of locations, including above the first location, the hoisting assembly having a main body, an attachable member, and an extendible member having a first end and a second end, the first end of the extendible member attached to the main body and the second end of the extendible member attached to attachable member, wherein when the hoisting assembly is positioned above the first location between the mooring line storage section and the mooring line channel section, the hoisting assembly is operable to control at least a position of a portion of a mooring line that is between the mooring line storage section and the mooring line channel section so as to be received by the transportable windlass subsystem.

15. The windlass assembly of claim 14, wherein the rotary member is configurable in such a way that, when the transportable windlass assembly is secured at the first location and when the transportable windlass assembly receives the first mooring line, the rotary member is operable to:

direct at least a portion of the mooring line into the mooring line storage section by rotating in the first direction; and direct at least a portion of the mooring line out of the mooring line storage section by rotating in the second direction.

16. The windlass assembly of claim 14, further comprising a windlass rail assembly;

wherein the windlass rail assembly is a rail extending between at least the first location and a second location different from the first location; and wherein the windlass rail assembly is operable to receive the transportable windlass assembly and enable the transportable windlass assembly to be transported between at least the first location and the second location.

17. The windlass assembly of claim 14, wherein the hoisting assembly is configurable in such a way that, when the hoisting assembly is positioned above the first location, the hoisting assembly is operable to move the portion of the mooring line that is between the mooring line storage section and the mooring line channel section away from the turret body top surface;

wherein the hoisting assembly is configurable in such a way that, when the hoisting assembly is positioned above the first location and when the portion of the mooring line between the mooring line storage section and the mooring line channel section is moved by the hoisting assembly to be away from the turret body top surface, the hoisting assembly is operable to control the position of the mooring line so as to be received by the transportable windlass subsystem when the transportable windlass subsystem is transported to the first position; and wherein the hoisting assembly is configurable in such a way that, when the transportable windlass subsystem is positioned at the first position and when the mooring line is received by the transportable windlass subsystem, the hoisting assembly is operable to control the position of the mooring line so as to be removed from the transportable windlass subsystem.

18. The windlass assembly of claim 14, further comprising a hoisting rail assembly, the hoisting rail assembly being a rail extending between at least a location above the first location and a location above a second location different from the first location, the hoisting rail assembly operable to receive the hoisting assembly and enable the hoisting assembly to be transported between at least the location above the first location and the location above the second location.

19. The windlass assembly of claim 14, further comprising a second transportable windlass assembly;

wherein the second transportable windlass assembly is configured to be securable to and transportable between a plurality of locations of the turret body;

wherein the second transportable windlass assembly comprises a second rotary member configurable to rotate in the first direction and the second direction;

wherein the second rotary member is configurable in such a way that, when the second transportable windlass assembly is secured at the first location and when the second transportable windlass assembly receives the mooring line, the second rotary member is operable to:

direct at least a portion of the mooring line into the mooring line storage section by rotating in the first direction; and direct at least a portion of the mooring line out of the mooring line storage section by rotating in the second direction.

20. The windlass assembly of claim 14, further comprising a controller in communication with the transportable windlass assembly, wherein the controller is operable to perform one or more of the following:

control the rotation of the rotary member;

configure the transportable windlass assembly to variably adjust a tension of the mooring line when the transportable windlass assembly is configured to be secured to the turret body at the first location and when a first end of the mooring line is secured to a bottom of a body of water via an anchor; and/or control the movement of the transportable windlass assembly between the first position and a second position different from the first position;

wherein the controller configures the transportable windlass assembly to variably adjust the tension of the mooring line based on a predetermined load/force calculation.

21. A turret system for use in a floating vessel, the floating vessel having a hull and a moon pool opening, the turret system comprising:

a turret body fixedly positionable in the moon pool opening and rotatable about a center axis defined by the moon pool opening, the turret body having:

a top surface;

a bottom surface opposite to the top surface;

a first mooring line storage section, the first mooring line storage section including a first opening in the turret body top surface and a first cavity formed between the turret body top surface and turret body bottom surface, wherein the first opening is operable to receive a first mooring line, and wherein the first cavity is operable to house at least a majority length of the first mooring line;

a first mooring line channel section formed through the turret body between the turret body top surface and turret body bottom surface, the first mooring line channel section being an elongated passageway for the first mooring line to pass between an exterior of the floating vessel and the first mooring line storage section;

a second mooring line storage section, the second mooring line storage section including a second opening in the turret body top surface and a second cavity formed between the turret body top surface and turret body bottom surface, wherein the second opening is operable to receive a second mooring line, and wherein the second cavity is operable to house at least a majority length of the second mooring line;

a second mooring line channel section formed through the turret body between the turret body top surface and turret body bottom surface, the second mooring line channel section being an elongated passageway for the second mooring line to pass between an exterior of the floating vessel and the second mooring line storage section, wherein the first and second mooring line channel sections are separate elongated passageways so as to enable the first mooring line and second mooring line, respectively, to be directed through the turret body to the exterior of the floating vessel without coming into contact with one another;

a first front mooring line stopper assembly operable to receive the first mooring line, the first front mooring line stopper assembly actuatable between a stop position and a release position, the first front mooring line stopper assembly provided between the first mooring line channel section and the first opening of the first mooring line storage section; and a first rear mooring line stopper assembly operable to receive the first mooring line, the first rear mooring line stopper assembly separate from the first front mooring line stopper assembly, the first rear mooring line stopper assembly actuatable between a stop position and a release position, the first rear mooring line stopper assembly provided between the first front mooring line stopper assembly and the first opening of the first mooring line storage section;

wherein, when the first front mooring line stopper assembly receives the first mooring line and when the first front mooring line stopper assembly is actuated to its stop position, the first front mooring line stopper assembly is operable to restrict a movement of the first mooring line through the first mooring line channel section;

wherein, when the first front mooring line stopper assembly is actuated to the its release position, the first front mooring line stopper assembly is operable to allow a movement of the first mooring line through the first mooring line channel section;

wherein, when the first rear mooring line stopper assembly receives the first mooring line and when the first rear mooring line stopper assembly is actuated to its stop position, the first rear mooring line stopper assembly is operable to restrict a movement of the first mooring line through the first opening of the first mooring line storage section; and wherein, when the first rear mooring line stopper assembly is actuated to the its release position, the first rear mooring line stopper assembly is operable to allow a movement of the first mooring line through the first opening of the first mooring line storage section.

* * * * *